US008471464B2

(12) United States Patent
Yamada et al.

(10) Patent No.: US 8,471,464 B2
(45) Date of Patent: Jun. 25, 2013

(54) INTEGRATED ILLUMINATION APPARATUS AND METHOD OF MANUFACTURING SAME

(75) Inventors: Makoto Yamada, Osaka (JP); Yoshimasa Fujita, Osaka (JP); Yuhki Kobayashi, Osaka (JP); Ken Okamoto, Osaka (JP); Hidenori Ogata, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 13/579,178

(22) PCT Filed: Feb. 16, 2011

(86) PCT No.: PCT/JP2011/053286

§ 371 (c)(1),
(2), (4) Date: Aug. 15, 2012

(87) PCT Pub. No.: WO2011/102389

PCT Pub. Date: Aug. 25, 2011

(65) Prior Publication Data

US 2012/0313512 A1 Dec. 13, 2012

(30) Foreign Application Priority Data

Feb. 17, 2010 (JP) ..... 2010-032404

(51) Int. Cl.
*H01J 1/62* (2006.01)

(52) U.S. Cl.
USPC ..... 313/504; 313/512

(58) Field of Classification Search
USPC ..... 313/498, 504, 506, 512
See application file for complete search history.

(56) References Cited

FOREIGN PATENT DOCUMENTS

| | | | |
|---|---|---|---|
| JP | 2001-82058 | A | 3/2001 |
| JP | 2006-127934 | A | 5/2006 |

OTHER PUBLICATIONS

International Search Report received for PCT Patent Application No. PCT/JP2011/053286, mailed on Mar. 22, 2011, 5 pages (2 pages of English Translation and 3 pages of International Search Report).

*Primary Examiner* — Vip Patel
(74) *Attorney, Agent, or Firm* — Morrison & Foerster LLP

(57) ABSTRACT

One or more illumination panels (10) are hung by up-and-down cords (3). The up-and-down cords (3) have a function of hanging the illumination panels (10) and a function of supplying electric power to the illumination panels (10). Pulling a rod (7), which is a take-up tool causes the up-and-down cords (3) to be taken up and, at the same time, the bottom rail (4) and the illumination panels (10) are also raised. At this time, the up-and-down cords (3) are taken up into the head box (2). As such, when the bottom rail (4) is raised, the up-and-down cords (3) are taken up without bending. This makes it possible to distribute stress that may otherwise be concentrated locally on the up-and-down cords (3). As a result, the up-and-down cords (3) can be prevented from getting broken due to deterioration caused by concentration of stress on the up-and-down cords (3), which concentration is caused by bending etc. of the up-and-down cords (3).

39 Claims, 6 Drawing Sheets

INTEGRATED ILLUMINATION APPARATUS AND METHOD OF MANUFACTURING SAME

CROSS REFERENCE TO RELATED APPLICATIONS

This is a U.S. National Phase patent application of PCT/JP2011/053286, filed Feb. 16, 2011, which claims priority to Japanese Patent Application No. 2010-032404, filed Feb. 17, 2010, each of which is hereby incorporated by reference in the present disclosure in its entirety.

TECHNICAL FIELD

The present invention relates to an integrated illumination device including a cord functioning as wire, and a method for manufacturing the integrated illumination device.

BACKGROUND ART

In recent years, a light source device that employs an organic electroluminescent element (hereinafter referred to as organic EL element) is attracting attention as a type of flat light source devices. The light source device employing the organic EL element has excellent properties such as self-light emission, wide viewing angle, and high-speed response.

The organic EL element generally includes an organic layer on a transparent substrate, which organic layer includes (i) a first electrode (anode) serving as a transparent electrode, (ii) a second electrode (cathode) serving as a reflecting electrode, and (iii) a light-emitting layer between the first electrode and the second electrode. The organic layer generally includes, in addition to the light-emitting layer, a hole transport layer, an electron transport layer, and the like. Application of a voltage of a few volts between the first electrode and the second electrode in the organic EL element causes a hole injected from the first electrode and an electron injected from the second electrode to be bound to each other again in the light-emitting layer. When the hole and the electron are bound to each other again in the light-emitting layer, an exciton is generated. The exciton emits light when it returns to its ground state. In this manner, the organic EL element emits light. In an organic EL element of a bottom emission type, light emitted from the organic EL element is taken out from a side where the first electrode and the transparent substrate are provided. In contrast, in an organic EL element of a top emission type, light emitted from the organic EL element is taken out from a second electrode side.

In order for the organic EL element to be used in a light source device, the organic EL element is required to have a large area. A vacuum process, which is one of methods for manufacturing the organic EL element, does not allow a large-sized organic EL element to be manufactured easily. This is due to an enormous amount of takt time resulting from technical difficulty in manufacturing an organic EL element by use of a large-sized substrate in the vacuum process.

In addition, installing an apparatus for manufacturing the large-sized organic EL involves an enormous cost. Because of these drawbacks, in fact, there has been reported no case of an organic EL element manufactured by use of a tenth-generation substrate, which currently is the largest-sized substrate.

In order to address the problem, a method has been employed recently, in which method a large-sized light source device is manufactured by mounting a plurality of small-area organic EL elements manufactured by use of a medium-sized vacuum film formation device. The method is highly feasible for the following reasons. That is, since a glass substrate is reduced in size, (1) a light source device with a large-area light-emitting surface can be manufactured by a simple method, (2) a manufacturing method according to vacuum evaporation manufacture, development of which is currently more advanced than a wet process and therefore has an advantage of being capable of achieving high light-emitting efficiency, can be applied, (3) a fixed cost for installing a manufacturing apparatus and a takt time can be reduced since a vacuum system of the manufacturing apparatus can be made compact, and (4) so on. In particular, a light source device in which a plurality of strip-like organic EL elements are mounted is coming into increasing use as a flat light source device. This light source device is called blind-type illumination device or the like because of its shape.

Recently, a blind-type illumination device in which a light-emitting element other than the organic EL element is mounted has been developed as well. For example, Patent Literature 1 discloses a blind-type illumination device manufactured by integrating a plurality of slats, in each of which a luminous body, which emits light by utilizing electric energy generated by a solar cell, is mounted. Specifically, the blind-type illumination device disclosed in Patent Literature 1 includes the solar cell, a secondary battery, and the luminous body. The secondary battery stores electric energy generated by the solar cell, and the luminous body emits light by receiving a voltage supplied by the secondary battery. In the blind-type illumination device disclosed in Patent Literature 1, the solar cell is provided on a light-blocking surface of the slats, which are plates (blades) of the blind, and solar energy is transformed into electric energy at the time of blocking light. This allows solar energy of blocked light to be converted into electric energy so as to be utilized as illumination for a room. Thus, effective use of solar energy is realized.

CITATION LIST

Patent Literature

Patent Literature 1
Japanese Patent Application Publication, Tokukai, No. 2001-82058 A (Publication Date: Mar. 27, 2001)

SUMMARY OF INVENTION

Technical Problem

The blind-type illumination device disclosed in Patent Literature 1 also functions as an interior shading blind for use as a usual window treatment. That is, the blind-type illumination device is designed so that the blind-type illumination device, when not in use, can be raised so as to be folded up. Since a wire that transmits, to the slats, a signal for controlling a light emission state and a non-light emission state of the luminous body of the blind-type illumination device is provided at a peripheral portion on a short axis side of the blind-type illumination device, the wire portion is bent at the time of raising and folding up the blind-type illumination device. This causes locally concentrated stress on the wire and, accordingly, a material of the wire, a material of a protection cover for the wire, and the like are degraded.

The present invention is accomplished in view of the problem. An object of the present invention is to provide (i) an integrated illumination device which (a) is capable of preventing degradation of a material of a wire of each of one or more illumination panels, a material of a protection cover for the wire, and the like by diffusing stress locally concentrated on the wire and (b) has a large area, and (ii) a method for manufacturing the integrated illumination device.

Solution to Problem

In order to attain the object, an integrated illumination device in accordance with the present invention is an integrated illumination device including: one or more illumination panels each including one or more organic electroluminescent elements; cords for holding the one or more illumination panels; and a tool (i) being capable of taking up or letting out the cords and (ii) causing the cords to move so as to adjust a position of each of the one or more illumination panels, each of the cords having conductivity, a conductive part of each of the cords being electrically connected with a corresponding one of electrodes of each of the one or more organic electroluminescent elements.

According to the configuration, the one or more illumination panels are held by the cords, and each of the cords is electrically connected with the corresponding one of the electrodes of the organic EL element. Furthermore, the cords can be taken up or let out by the tool. Therefore, the cords have a function of supplying electric power to the organic EL element, as well as a function of holding the one or more illumination panels so as to take up each illumination panel. In the integrated illumination device in accordance with the present invention, the position of each illumination panel can be adjusted by means of the tool. Specifically, by causing the cords to move by means of the tool, the position (height, inclination, and distance from an adjacent panel) of the one or more illumination panels can be adjusted. In a multi-rod type integrated illumination device, the tool can be, for example, a rod or the like.

Conventionally, cords for holding each of the one or more illumination panels are provided separately from wires for applying voltages to each illumination panel. As such, wires are inevitably bent when the cords are taken up so that illumination panels collect together in a pile. To "bend" here denotes a state in which a wire is bent with a radius of curvature small enough to cause deterioration of the wire. If the wire is repeatedly brought in such a state or remains in the state for a long period of time, intensively localized stress is applied on the wire. This causes deterioration of the wire.

However, in the present invention, the cords for holding the one or more illumination panels additionally function as wires for supplying electric power to each illumination panel. As such, even in a state where the cords functioning as the wires are taken up when the one or more illumination panels are caused to collect together in a pile, each of the cords has a radius of curvature large enough to distribute stress that may otherwise be locally concentrated on the each of the cords. Therefore, deterioration of the cords does not occur and, accordingly, the cords are prevented from getting broken.

The scope of the term "bend" used in the Description does not encompass taking up or letting out. Therefore, it should be noted that, in the act of taking up a cord and the act of letting out the cord, which acts are means for solving problems of the present invention, a state in which the cord has been taken up is not encompassed in the definition of a state of being bent.

Furthermore, in the present invention, a plurality of illumination panels each including a plurality of small-sized organic EL elements are provided, so that a large-area integrated illumination device is realized and a manufacturing cost is reduced.

A method for manufacturing an integrated illumination device in accordance with the present invention is method for manufacturing an integrated illumination device which includes: one or more illumination panels each including an organic electroluminescent element; cords for holding the one or more illumination panels; and a tool (i) being capable of taking up or letting out the cords and (ii) causing the cords to move so as to adjust a position of each of the one or more illumination panels, said method comprising the steps of: forming the organic electroluminescent element by sequentially forming, on a substrate, at least an anode, an organic layer including a light-emitting region, and a cathode; forming the each of the one or more illumination panels by sealing up the organic electroluminescent element in a gap between the first substrate and the second substrate; connecting each of the cords, which have conductivity, with a corresponding one of the anode and the cathode of the organic electroluminescent element; and forming the tool.

According to the method, it is possible to provide an integrated illumination device in which (i) locally concentrated stress on a cord can be reduced when a plurality of illumination panels are caused to collect together in a pile, (ii) the cord can be accordingly prevented from being deteriorated, and (iii) the cord can be prevented from getting broken.

In addition, provision of a plurality of illumination panels each including a plurality of small-sized organic EL elements makes it possible to realize a large-area integrated illumination device and a reduction in manufacturing cost.

Additional objects, features, and strengths of the present invention will be made clear by the description below. Further, the advantages of the present invention will be evident from the following explanation in reference to the drawings.

Advantageous Effects of Invention

In the integrated illumination device in accordance with the present invention, the cords suspending each illumination panel function as wires for supplying electric power to each illumination panel. As such, when the cords are taken up so as to raise the plurality of illumination panels, the wires of the integrated illumination device are taken up without bending. Since the cords, i.e., wires do not bend at the time of raising the plurality of illumination panels, it is possible to reduce localized concentration of pressure on each of the wires. This prevents the wire from getting deteriorated and, accordingly, the wire can be prevented from getting broken. Furthermore, the provision of the plurality of small-sized organic EL elements makes it possible to realize a large-area integrated illumination device and a reduction in manufacturing cost.

BRIEF DESCRIPTION OF DRAWINGS

FIG. 1 is a schematic view illustrating an organic EL illumination device in accordance with an embodiment of the present invention.

FIG. 2 is a schematic view illustrating an organic EL panel in accordance with an embodiment of the present invention.

FIG. 3 is a cross-sectional view of an illumination panel in accordance with an embodiment of the present invention.

FIG. 4 is a cross-sectional view of an organic EL element in accordance with an embodiment of the present invention.

FIG. 5 is a view illustrating an example of arrangement of an organic EL element in accordance with an embodiment of the present invention.

FIG. 6 is a cross-sectional view of an organic EL illumination device in accordance with an embodiment of the present invention, in which a light-emitting portion is expanded by providing (i) an organic EL element of a bottom emission type on the first substrate and (ii) an organic EL element of a top emission type on the second substrate.

FIG. 7 is a cross-sectional view of an organic EL illumination device in accordance with an embodiment of the present invention, in which a light-emitting portion is expanded by providing an organic EL element of a bottom emission type on each of the first substrate and the second substrate.

FIG. 8 is a cross-sectional view of an organic EL illumination device in accordance with an embodiment of the present invention, in which an organic EL element of a top emission type is provided on a first substrate, and light reflected by a second substrate having a light-reflecting property is taken out via the organic EL element, thereby realizing indirect illumination.

FIG. 9 is a cross-sectional view of a double-sided emission type organic EL illumination device in accordance with an embodiment of the present invention.

Figure 10:
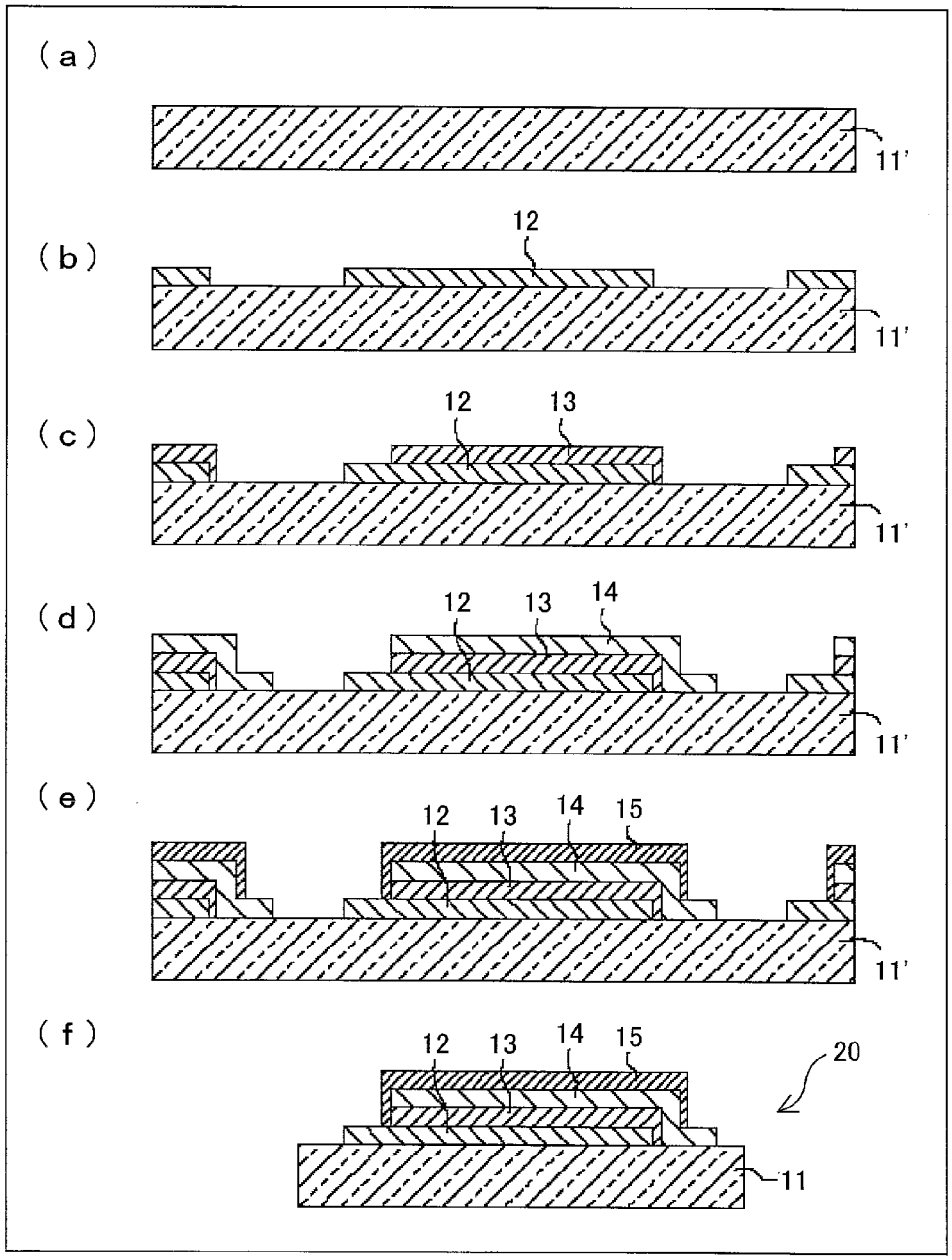
FIG. 10

(*a*) of FIG. 10 is a view showing a step of preparing a support substrate. (*b*) of FIG. 10 is a view showing a step of forming a first electrode. (*c*) of FIG. 10 is a view showing a step of forming an organic EL layer. (*d*) of FIG. 10 is a view showing a step of forming a second electrode. (*e*) of FIG. 10 is a view showing a step of forming a protection film. (*f*) of FIG. 10 is a view showing a step of cutting out an organic EL element.

FIG. 11

Figure 11:
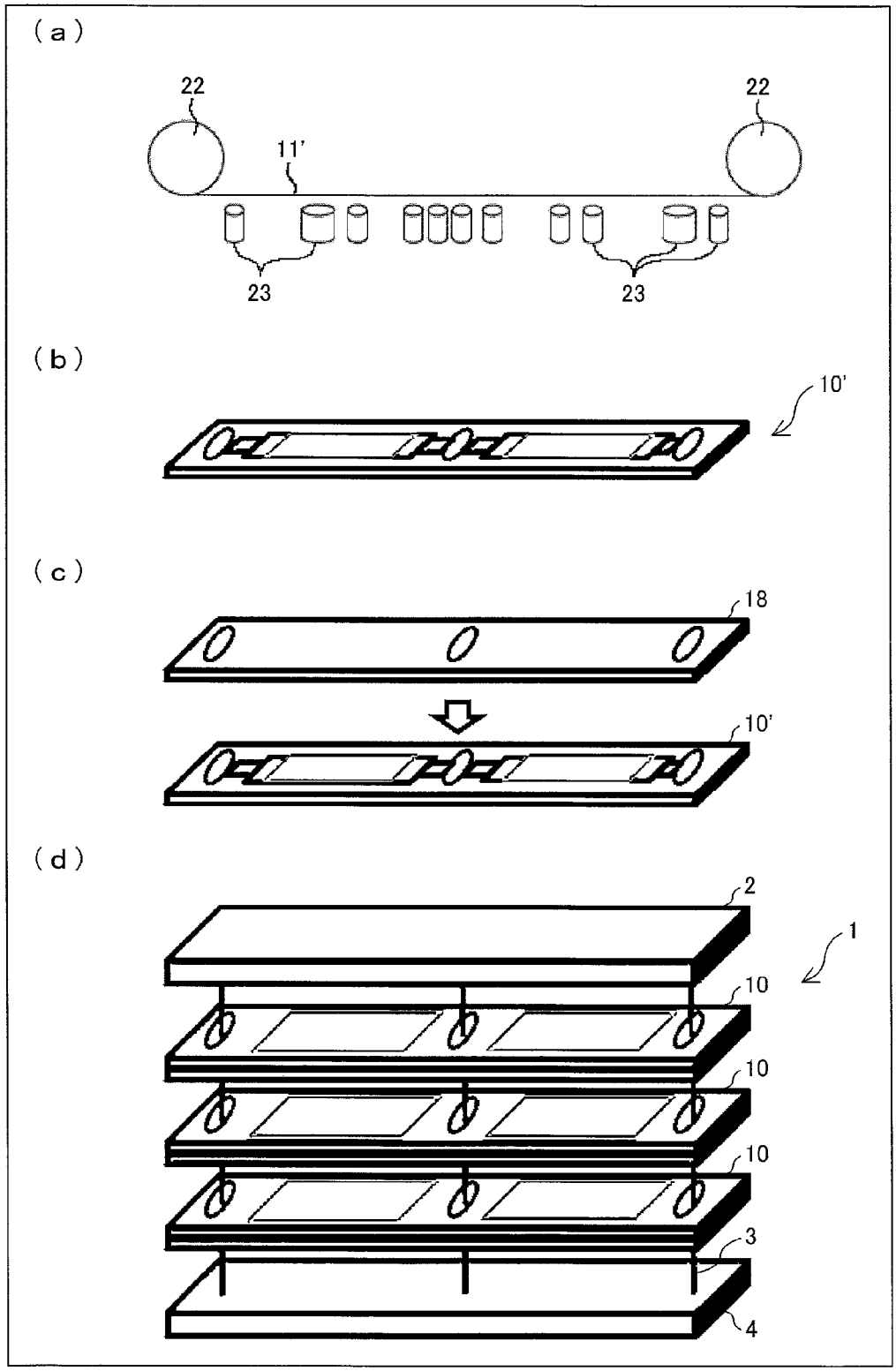

(*a*) of FIG. 11 is a schematic view illustrating a roll-to-roll deposition apparatus for forming an organic EL element. (*b*) of FIG. 11 is a view showing a state in which organic EL elements are placed on a first substrate. (*c*) of FIG. 11 is a view showing a step of placing a second substrate so as to cover the first substrate. (*d*) of FIG. 11 is a view showing a state in which a plurality of illumination panels are provided between a head box and a bottom rail.

DESCRIPTION OF EMBODIMENTS (General Description of Organic EL Illumination Device)

Figure 1:
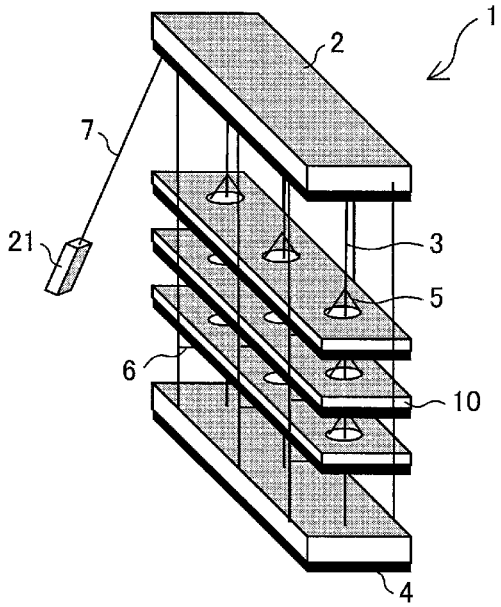
FIG. 1

A general description of an organic electroluminescent (organic EL) illumination device in accordance with the present embodiment is given below with reference to FIG. 1. FIG. 1 is a schematic view illustrating an organic EL illumination device 1.

The organic EL illumination device 1 in accordance with the present embodiment can be suitably applied to, for example, office illumination, store illumination, facility illumination, stage illumination, illumination for dramatic presentation, outdoor illumination, home illumination, display illumination (for a pachinko game machine, a vending machine, a freezer showcase, a refrigerator showcase, or the like), lighting built in a machine or an article of furniture, evacuation light, focal lighting, and the like.

As illustrated in FIG. 1, the organic EL illumination device 1 includes a head box 2, up-and-down cords (cord) 3, a bottom rail 4, branch wires 5, ladder cords (support cords) 6, a rod (tool) 7, and one or more illumination panels 10. Note that the rod 7 is an example of a tool for taking up the up-and-down cords 3. The one or more illumination panels 10 are provided between the head box 2 and the bottom rail 4. Specifically, the one or more illumination panels 10 are suspended and held by the up-and-down cords 3, which extend from the head box 2 and have conductivity. Each illumination panel 10 is electrically connected with the up-and-down cords 3 via the branch wires connected with conductive parts of the up-and-down cords 3.

Figure 2:
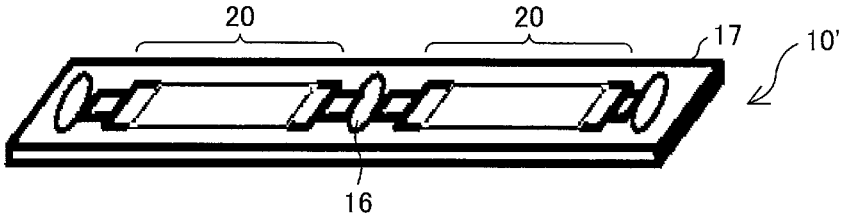
FIG. 2

An illumination panel 10 is constituted by an organic EL panel and a second substrate that covers the organic EL panel. Details of the organic EL panel are illustrated in FIG. 2. FIG. 2 is a schematic view illustrating an organic EL panel 10'. As illustrated in FIG. 2, the organic EL panel 10' is constituted by a first substrate 17 and one or more organic EL elements 20 provided on the first substrate 17. A plurality of holes 16 are provided on the first substrate 17, and the up-and-down cords 3 are passed through the respective plurality of holes 16. Although FIG. 2 shows a configuration in which two organic EL elements 20 are provided on the first substrate 17, the present embodiment is not limited to the configuration and can employ, for example, a configuration in which (i) one organic EL element 20 is provided on the first substrate 17 or (ii) three or more organic EL elements 20 are provided on the first substrate 17.

The head box 2 and the bottom rail 4 are connected with each other via the ladder cords 6, and each illumination panel 10 is placed on the ladder cords 6. That is, each illumination panel 10 is supported by the ladder cords 6. The rod 7 is connected with tips of the respective up-and-down cords 3 in the head box 2. Pulling a grip 21 at a tip of the rod 7 causes the up-and-down cords 3 to be taken up in a vertical direction. This causes the bottom rail 4 to be taken up and the one or more illumination panels 10 to be raised. The taking up of the up-and-down cords 3 connected with the tip of the rod 7 allows the positions of the respective one or more illumination panels 10 to be adjusted.

At this time, the up-and-down cords 3 suspending the one or more of illumination panels 10 are taken up into the head box 2 at the same time as the bottom rail 4 and the one or more illumination panels 10 are raised. Likewise, the ladder cords 6 are taken up into the head box 2 at the same time as the bottom rail 4 and the one or more illumination panels 10 are raised. Thus, the up-and-down cords 3 are taken up into or let out from the head box 2 by means of the rod 7. As such, when the bottom rail 4 is taken up, the up-and-down cords 3 are taken up without bending. This allows distributing stress that might otherwise concentrate locally on each of the up-and-down cords 3. This makes it possible to prevent the up-and-down cords 3 from getting broken because of deterioration caused by stress locally concentrated on the up-and-down cords 3. This will be described later in detail.

(Configuration of Illumination Panel 10)

Figure 3:
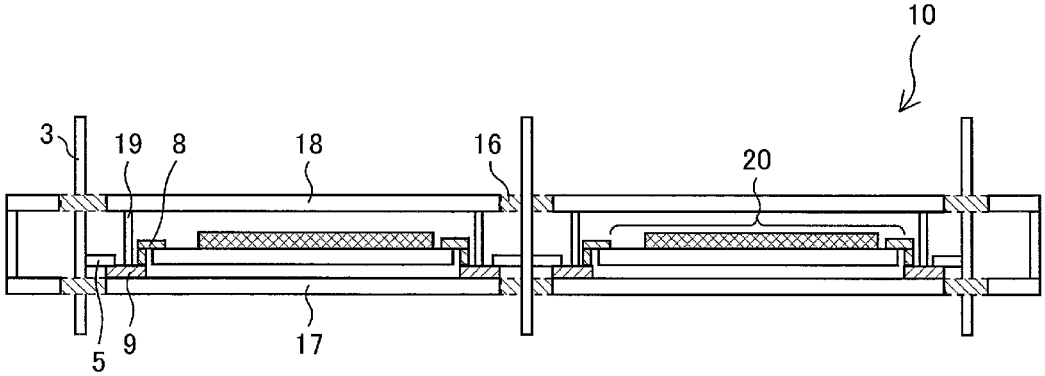
FIG. 3

The following description will discuss in detail a configuration of an illumination panel 10, with reference to FIG. 3. FIG. 3 is a cross-sectional view of the illumination panel 10.

As illustrated in FIG. 3, the illumination panel 10 is constituted by (i) the first substrate 17 including the one or more organic EL elements 20 and (ii) the second substrate 18 provided to face the first substrate 17. Specifically, the first substrate 17 and the second substrate 18 are connected with each other via resin 19. The first substrate 17 has a plurality of holes 16, and the second substrate 18 also has a plurality of holes 16 at places that face the respective plurality of holes 16 of the first substrate 17. The holes 16 are preferably provided at positions other than (i) a center of the first substrate 17 and (ii) a center of the second substrate 18. According to this, the plurality of holes 16 are provided at places other than a center of the illumination panel 10. This allows securing a large area for a light-emitting portion of the illumination panel 10 and accordingly enhancing luminance and illuminance. The up-and-down cords 3 are passed through the respective plurality of holes 16, and the branch wires 5 connected with the up-and-down cord 3 are connected with respective conductive wires 9 provided on the first substrate 17. Each of the conductive wires 9 is connected with an organic EL element 20 via a connection wire 8. Since the up-and-down cords 3 have a function (wire function) as a wire for supplying electric power to the illumination panel, each organic EL elements 20 are electrically connected with the up-and-down cords 3. That is, the illumination panel 10 is not only suspended by the up-and-down cords 3 but also electrically connected with the up-and-down cords 3.

Figure 4:
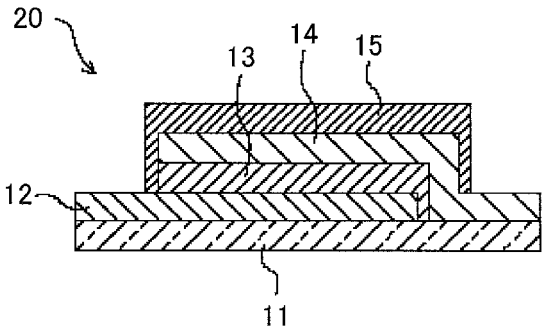
FIG. 4

As described above, the illumination panel 10 includes the one or more organic EL elements 20. Details of an organic EL element 20 are shown in FIG. 4. FIG. 4 is a cross-sectional view of the organic EL element 20. As illustrated in FIG. 4, the organic EL element 20 includes a support substrate 11, and the first electrode 12, an organic EL layer 13, and the second electrode 14 which are sequentially laminated on the support substrate 11. For protection of the first electrode 12, the second electrode 14, and the organic EL layer 13, it is preferable that a protection layer 15 be provided so as to cover a surface of the second electrode 14. In the organic EL element 20, a voltage is applied to the first electrode 12 and the second electrode 14, so that (i) a hole is injected from one of the first electrode 12 and the second electrode 14 and (ii) an electron is injected from the other of the first electrode 12 and the second electrode 14. The organic EL layer 13 includes a light-emitting layer. The hole and the electron having been injected are bound to each other again in the light-emitting layer, so that the organic EL element 20 emits light.

It is only necessary that the organic EL layer 13 include at least the light-emitting layer. The organic EL layer 13 can have, for example, a three-layer structure in which a hole transport layer, a light-emitting layer, and an electron transport layer are laminated. Alternatively, the organic EL layer 13 can have (i) a five-layer structure in which a hole injection layer, a hole transport layer, a light-emitting layer, an electron transport layer, and an electron injection layer are laminated or (ii) a seven-layer structure in which a hole injection layer, a hole transport layer, an electron blocking layer, a light-emitting layer, a hole blocking layer, an electron transport layer, and an electron injection layer are laminated. Alternatively, contrary to these structures in each of which layers have respective different functions, the organic EL layer 13 can have a single-layer structure consisting of a positive and negative charge transporting light-emitting layer having high hole transportability, high electron transportability, and a good balance between the hole and the electron. This structure provides high light-emitting efficiency since a positive and negative charge transporting material (1) can cause the hole injected from the anode and the electron injected from the cathode to be transmitted, with high mobility and a good balance, to a light-emitting region and (2) has a sufficiently large energy gap (about 3 eV) between a Highest Occupied Molecular Orbital (HOMO) and a Lowest Unoccupied Molecular Orbital (LUMO) and is a wide gap material. In this case, the organic layer is a single layer and therefore has (i) a light-emitting region corresponding to the light-emitting layer, (ii) a hole blocking region corresponding to the hole blocking layer, (iii) an electron blocking region corresponding to the electron blocking layer, and (iv) the like. The organic EL element 20 can have, for example, a shape of a rectangular flat plate having a width of about 50 mm, a length of about 450 mm, and a thickness of about 0.7 mm. Note, however, that the organic EL element 20 is not necessarily limited to this.

(Configuration of Organic EL Illumination Device 1)

As described above, the one or more illumination panels 10 are provided on the ladder cords 6 between the head box 2 and the bottom rail 4. The one or more illumination panels 10 are connected with each other via the up-and-down cords 3 extending from the head box 2. The up-and-down cords 3 suspend each illumination panel 10 and also function as wires for supplying electric power to each illumination panel 10. The rod 7 is connected with the tips of the respective up-and-down cords 3 in the head box 2. Pulling the grip 21 at the tip of the rod 7 causes the bottom rail 4 and the one or more illumination panels 10 to be raised. At this time, the up-and-down cords 3 are taken up into the head box 2 at the same time as the bottom rail 4 and the one or more illumination panels 100 are raised.

It is preferable that each of the up-and-down cords 3 be relaxed to the extent that it does not bend nor stretch to its full length even in a state where the bottom rail 4 is lowered. According to this, concentration of stress on the up-and-down cords 3, which concentration is caused by the one or more illumination panels 10, hardly occurs. This prevents the up-and-down cords 3 from getting broken due to concentration of stress on the up-and-down cords 3, which concentration is caused by the one or more illumination panels 10. It is also preferable that the up-and-down cord 3 be made from a material having elasticity. According to this, even if concentration of stress on the up-and-down cords 3 is caused by the one or more illumination panels 10, the concentration of stress can be reduced. This allows the organic EL illumination device 1 to be used for a long time.

Conventionally, a cord for taking up illumination panels and a wire for applying a voltage to the illumination panels are separately provided. As such, when the illumination panels are raised, the wire is bent, so that stress is heavily and locally concentrated on the wire. As a result, a wire material, a protection cover material for the wire, and the like are deteriorated. However, in the organic EL illumination device 1 in accordance with the present embodiment, the up-and-down cords 3 suspending each illumination panel 10 have function as wires. As such, by taking up the up-and-down cords 3 at the time of raising each illumination panel 10, the wires of the organic EL illumination device 1 are taken up without bending. Therefore, since the up-and-down cords 3, i.e., the wires do not bend when each illumination panel 10 is raised, it is possible to reduce stress locally concentrated on the wires. Accordingly, deterioration of the wires (up-and-down cords 3) is not invited and the wires are prevented from getting broken. In addition, by providing the plurality of illumination panels each including the plurality of small organic EL elements, it is possible to realize a large-area integrated illumination device and reduce manufacturing costs.

The description above has discussed a configuration in which the up-and-down cords 3 pass through the respective plurality of holes 16, but the present embodiment is not necessarily limited to this. For example, in a case of using illumination panels 10 having no hole 16, it is only necessary that (i) at least one up-and-down cord 3 be provided at the peripheries of the illumination panels 10 and (ii) a connection wire 8 of the each illumination panel 10 be connected with the up-and-down cord 3. Specifically, it would suffice to extend the connection wire 8 to the outside of the each illumination panel 10 so that the connection wire 8 is connected with the up-and-down cord 3.

In a case where one or more organic EL elements 20 are arranged, one up-and-down cord 3 can have a function of more than one wire. For example, one up-and-down cord 3 can be constituted by a plurality of wires such as a positive wire and a negative wire. Contrary to this, a wire function can by distributed among a plurality of up-and-down cords 3. This reduces a voltage flowing through each of the plurality of up-and-down cords 3, so that light emission unevenness can be prevented.

The connection point between an up-and-down cord 3 and a branch wire 5 connected with the up-and-down cord 3 can be either fixed or movable by sliding etc., provided that the up-and-down cord 3 and the branch wire 5 are electrically connected with each other. A plastic cover or the like can be attached to the branch wire 5 so as to prevent the branch wire 5 from touching another wire.

In the organic EL illumination device 1, the up-and-down cords 3 passes through the respective holes 16 of each illumination panel 10, but the each illumination panel 10 and the up-and-down cords 3 are merely connected with each other via the branch wires 5. In addition, each illumination panel 10 is merely placed on the ladder cords 6. Therefore, the illumination panels 10 are not fixed to the up-and-down cords 3 and the ladder cords 6. As such, by causing the ladder cords 6 to move by means of the rod 7 so as to cause the illumination panels 10 to rotate with a rotation angle controlled, it is possible to tilt the illumination panels 10 vertically. An organic EL illumination device 1 that has a function of adjusting an angle of the illumination panels 10 can control the illumination panel 10 to have a desired angle. Such organic EL illumination device 1 can serve as direct illumination and indirect illumination. When the organic EL illumination device 1 is not in use, it is possible to raise the illumination panels 10 by pulling the rod 7.

The organic EL illumination device in accordance with the present embodiment is exemplified as one having an arrangement in which each illumination panel 10 are suspended sideways (horizontally), that is, a Venetian-type illumination device. Note, however, that the present embodiment is not necessarily limited to this. For example, an arrangement in which each illumination panel 10 are suspended upright (vertically), i.e., a vertical-type illumination device, can be employed. In a case of the vertical-type illumination device, the one or more illumination panels 10 can be drawn by being caused to slide to the right or left (horizontal direction). It is also possible to make the organic EL illumination device 1 serve as direct illumination and indirect illumination by adjusting the angle (angle of rotation) of the illumination panels 10 by horizontally rotating each illumination panel 10. In general, in the vertical-type blind, a cord corresponding to an up-and-down cord 3 of the Venetian-type blind is called drive cord, and a vertically held blade (vertically held illumination panel 10) corresponding to the slat (horizontally held illumination panel 10) of the Venetian-type is called louver.

Needless to say, not only a multiple-rod type but also a cord-and-rod type, a cord-type, or the like can be employed in the organic EL illumination device 1. Also needless to say, the organic EL illumination device 1 can be operated not only by a manual changing method in which the rod 7 is used but also by an electrical operation method such as (i) remote and wireless control using a switch, a remote controller, or the like or (ii) sensitive control method by means of a sensor or the like.

(General Description of First Substrate 17 and Second Substrate 18)

The following description will discuss in detail members constituting the illumination panel 10.

First, the first substrate 17 and the second substrate 18 are described. At least one of the first substrate 17 and the second substrate 18 is made from a material having optical transparency. The material having optical transparency can be, for example, a transparent material such as a glass substrate and a resin substrate. In a case where one of the substrates is made from a material that does not have optical transparency, the material can be an opaque metal material or the like.

Each of the first substrate 17 and the second substrate 18 can be made from a material having flexibility such as PET or PEN. In this case, it is possible to bend the organic EL illumination device 1 without problems since the first substrate 17 and the second substrate 18 are bendable. As described above, each of the first substrate 17 and the second substrate 18 can have a flat plate-like shape or a shape having a curved surface. Each of the first substrate 17 and the second substrate 18 can have a convexly or concavely curved surface on a light exit surface side of the organic EL illumination device 1. According to this, in a case where the first substrate 17 and the second substrate 18 each have a convexly curved surface on the light exit surface side of the organic EL illumination device 1, light emitted from the organic EL illumination device 1 can be easily diffused. This allows lighting up a wide area of a room or space in which the organic EL illumination device 1 is provided. In contrast, in a case where the first substrate 17 and the second substrate 18 each have a concavely curved surface on the light exit surface side of the organic EL illumination device 1, light emitted from the organic EL illumination device 1 can be easily condensed. This allows lighting up, in a concentrated manner, a point, a plane, or the like close to where the organic EL illumination device 1 is provided. It is also possible to employ a configuration in which adjusting means capable of appropriately adjusting a curvature of each of the first substrate 17 and the second substrate 18 is provided. The configuration allows a wider variety of designs of the organic EL illumination device 1. In order to enhance gas barrier property and mechanical strength and reduce gas permeability, (i) an organic-inorganic hybrid layer, (ii) a multilayer film constituted by an organic layer and an inorganic layer, or (iii) the like can be provided on the surface of the material having flexibility.

Each of the first substrate 17 and the second substrate 18 can, for example, have a shape of a rectangular flat plate having a width of about 70 mm, a length of about 1000 mm, and a thickness of about 0.7 mm. Note that the present embodiment is not necessarily limited to this.

The first substrate 17 and the second substrate 18 are provided so as to sandwich the organic EL element 20. The first substrate 17 and the second substrate 18 are connected with each other via the resin 19 such as thermo-setting resin and UV-curable resin. A region surrounded by the first substrate 17 and the second substrate 18, that is, an area in which the organic EL element 20 is sealed up is controlled to be, for example, under an inert gas such as nitrogen gas or argon gas or under vacuum. Filling the area between the first substrate 17 and the second substrate 18 with an inert gas or controlling the area to be under vacuum in this manner allows preventing oxygen or water from entering from outside into the organic EL layer 13 of the organic EL element 20. This eliminates the need for each organic EL element 20 to be subjected to treatment for giving a gas barrier property to the organic EL element 20.

The region between the first substrate 17 and the second substrate 18 can contain a moisture absorbent such as barium oxide. This allows the surrounding of the organic EL element 20 to be maintained in a dry state. The region between the first substrate 17 and the second substrate 18 can be filled with heat-radiating resin having high thermal conductivity. The heat-radiating resin can be, for example, insulating acrylic rubber, ethylene-propylene rubber, or the like. According to this, filling the region between the first substrate 17 and the second substrate 18 with the heat-radiating resin having high thermal conductivity allows (i) heat in the region between the first substrate 17 and the second substrate 18 to be efficiently released to the outside and (ii) thermal uniformity to be improved.

One of the first substrate 17 and the second substrate 18 of the illumination panel, which one is not on the light exit surface side, is preferably made from a light-reflecting material or a material having a light-reflecting surface. It is also preferable that the gap between the first substrate 17 and the second substrate 18 be surrounded and sealed up by a light-reflecting material or a material having a light-reflecting surface. With this configuration, light emitted from a surface of the organic EL element 20 other than a light exit surface of the organic EL element 20 is reflected on a wall surface of the illumination panel 10 (wall surface of the illumination panel 10 which wall surface surrounds the organic EL element 20). Accordingly, light leaking out of the organic EL element 20 can be taken out more efficiently.

(General Description of Wire)

The conductive wires 9 are provided on a surface of the first substrate 17 on a side where the organic EL element 20 is provided. The conductive wires 9 extend in a width direction of the organic EL element 20. The conductive wires 9 can be made from, for example, ITO, IZO, an alkali metal, an alkali earth metal, or the like. Each of the conductive wires 9 can have, for example, a width of about 2 mm, a length of about 20 mm, and a thickness of about 150 mm, but is not necessarily limited to this.

Each two of the conductive wires 9 is paired. One of each pair of conductive wires 9 is connected with the first electrode 12 of the organic EL element 20 and the other is connected with the second electrode 14. Passing an electric current through the pair of conductive wires allows a voltage to be applied to the organic EL element 20. It is preferable that each pair of conductive wires 9 can be individually controlled. This allows an organic EL element 20 connected with a pair of conductive wires 9 to be driven independently. Therefore, since the organic EL elements 20 can be driven independently from each other, light emitted from the organic EL illumination device 1 can be controlled in terms of light emission intensity, color tone, and the like.

In order to impart a light controlling property and a color controlling property to the organic EL illumination device 1, it is possible to use (i) one organic EL element 20 has a plurality of areas of respective different colors or (ii) a plurality of types of organic EL elements 20 having respective different luminescent colors. This will be described later in detail. In a case where one organic EL element 20 has a plurality of areas of respective different colors, a plurality of conductive wires 9 are arranged in parallel with each other in a longitudinal direction.

For example, in a case of realizing a white color by means of three types (red, green, and blue) of organic EL elements 20, voltages should be applied to the conductive wires 9 for the respective organic EL elements 20 so that a lighting rate of a red light-emitting organic EL element (R) is 30%, a lighting rate of a green light-emitting organic EL element (G) is 22%, and a lighting rate of a blue light-emitting organic EL element (B) is 48%. The lighting rate here denotes a ratio of (i) an electric current flowing through an anode or a cathode of the illumination panel 10 to (ii) a maximum electric current that flows through the anode or the cathode (note that a duty ratio is 1/1). For example, in a case where (i) the maximum electric current that flows through the cathode is 200 mA and (ii) an electric current of 60 mA flows at a duty ratio of 1/1, the lighting rate is 30% (60/200=0.3). The description above has discussed an example of controlling the color into a white color, but the present embodiment is not necessarily limited to this.

The conductive wires 9 electrically connect the branch wires 5 with the organic EL element 20. Specifically, each of the conductive wires 9 connected with the respective branch wires 5 is connected with the organic EL element 20 via the connection wire 8. The connection wire 8 is preferably made of lead-free solder, silver paste, or the like.

In a case of using a rectangular organic EL element 20, an auxiliary electrode or an auxiliary wire can be provided along a longitudinal direction of the organic EL element 20. This makes it possible to reduce a decrease in voltage caused by resistance of the first electrode 12 and resistance of the second electrode 14. Accordingly, light emission unevenness can be reduced. The auxiliary electrode can be provided along the entire circumference of the organic EL element, or can be provided partially at an end or both ends of a long side of the organic EL element.

(General Description of Support Substrate 11)

The following description will discuss in detail the members constituting the organic EL element 20.

First, the support substrate 11 is described. The support substrate 11 is preferably made of an insulating material. Examples of the insulating material encompass a transparent plastic film of such as drawn polypropylene (OPP), polyethylene naphthalate (PEN), polyethylene terephthalate (PET), or polyphenylene sulfide (PPS). In the case of using the insulating material as the support substrate 11, the support substrate 11 can be employed as an insulating film. Note that the present embodiment is not necessarily limited to this, and an insulating film can be separately provided on the support substrate 11. It is preferable that a protection film such as a silicon oxide film be provided on the support substrate 11. This can prevent an alkali oxide from flowing out from the inside of the support substrate 11.

Furthermore, even if the place (the first substrate 17) at which the organic EL element 20 is to be provided is curved, use of a material having flexibility such as the plastic film as described above allows the organic EL element 20 to be provided without problems. According to this, in a case where the light exit surface of the organic EL element 20 is concavely curved, light emitted from the organic EL element 20 can be easily diffused. This allows lighting up a large area of a room or a space in which the organic EL illumination device 1 is provided. In contrast, in a case where the light exit surface of the organic EL element 20 is convexly curved, light emitted from the organic EL element 20 can be easily condensed. This allows lighting up, in a concentrated manner, a point, a plane, or the like close to where the organic EL illumination device 1 is provided. Furthermore, according to the configuration, even in a case where the illumination panel 10 is not curved itself, merely causing the organic EL element 20 to be curved brings about the effects as described above.

In addition, since the support substrate 11 has flexibility, the organic EL element 20 can be manufactured by roll-to-roll method. This allows reducing an initial investment for installing apparatus, running costs, and the like. By packing the support substrate 11 from both sides thereof by use of a substrate or the like having low oxygen permeability or water permeability, it is possible to manufacture an organic EL element 20 which eliminates the need for an organic multilayer film, an inorganic multilayer film, and the like and is inexpensive. Note, however, that the present embodiment is not limited to this. For example, the support substrate 11 can be made from a material such as glass.

The support substrate 11 can be made from a light-reflecting material such as a metal film. In this case, it is preferable that an insulating film such as (i) a synthetic resin such as epoxy resin, (ii) silicon nitride (SiNx) formed by means of a plasma CVD apparatus or the like to have a thickness of about 500 nm, or (iii) the like be provided on a surface of the support substrate 11.

A material having a light-diffusing property can be further added to the support substrate 11. Examples of the material having a light-diffusing property encompass (i) acrylic particles of an acrylic copolymer, an acrylic terpolymer, or the like of methyl methacrylate, ethyl methacrylate, isobutyl methacrylate, normal butyl methacrylate, normal butyl methyl methacrylate, methyl methacrylate, methyl acrylate, (ii) olefin particles of polyethylene, polystyrene (PS), polypropylene, or the like, and (iii) a copolymer of acrylic particles and olefin particles. Alternatively, the material having the light-diffusing property can be multilayer multicomponent particles or the like obtained by forming particles of a single polymer and subsequently coating the particles of the single polymer with another type of monomer, or the like since such particles have a light-diffusing property.

In general, light emitted by the organic EL element 20 is diffused widely. As such, a microcavity (micro resonator) structure is usually employed to adjust an optical path length, thereby causing the light emitted by the organic EL element 20 to be resonated and collected. This allows light-emitting efficiency and color purity to be improved and the light to have directivity and the like. In contrast, in the present embodiment, the material having the light-diffusing property is added to the support substrate 11, thereby causing the light emitted by the organic EL element 20 to be transmitted through a light-diffusing portion and emitted from the light exit surface so as to be uniformly diffused. This allows (i) the color purity and the light-emitting efficiency of the organic EL illumination device 1 to be improved and (ii) a wider viewing angle to be achieved.

(General Description of First Electrode 12 and Second Electrode 14)

Next, the first electrode 12 and the second electrode 14 are described. One of the first electrode 12 and the second electrode 14 is a cathode and the other is an anode. Examples of a material of the anode encompass indium tin oxide (ITO) or indium zinc oxide (IZO).

Examples of a material for the cathode encompass an alkali metal, an alkali earth metal, and the like. For stability, the cathode is preferably constituted by a calcium film, an aluminum film, a laminated film consisting of a calcium film and an aluminum film, a magnesium alloy film, a barium film, a barium compound film, a cesium film, a cesium compound film, a fluorine compound film, or the like.

In a case where the organic EL element 20 is of a bottom emission type, it is preferable that the first electrode 12 be made from an optically transmissive or semi-transmissive material (transparent electrode) and the second electrode 14 be made from a light-reflecting material. Conversely, in a case where the organic EL element 20 is of a top emission type, it is preferable that the first electrode 12 be made from a light-reflecting material and the second electrode 14 be made from an optically transmissive or semi-transmissive material (transparent electrode or semi-transparent electrode). This allows light emitted by the organic EL element 20 to exit from a transparent electrode side, thereby enabling an efficient extraction of light to the outside of the organic EL element 20. In addition, by configuring the electrode on a light extraction side to be a transparent electrode, it is possible to condense light by a microcavity (micro resonator) effect. This allows light-emitting efficiency and color purity to be improved and allows light to have directivity and the like. Furthermore, by employing a reflecting electrode as an electrode on an opposite side of the light extraction side, light having been emitted from the organic EL element 20 to a non-light exit surface side can be reflected by an electrode having light reflectivity so as to exit from the light exit surface side. This allows light emitted by the organic EL element 20 to be utilized more efficiently.

Note that the organic EL element 20 has a light emission distribution similar to the Lambert distribution, in which light intensity is isotropic. Therefore, light emitted by the organic EL element 20 can be condensed by utilizing a microcavity effect which is obtained by sandwiching the organic layer between the reflecting electrode and the transparent electrode. By employing a transparent electrode on a light exit side and a reflecting electrode on the opposite side of the light exit side, multiple reflection interference, in which light is repeatedly reflected between two electrodes, is caused so that the light is resonated and intensified. And then, only light whose optical path length matches an optical path length between the electrodes is taken out, so that a light emission luminance of the organic EL element 20 is enhanced. According to this, (i) unnecessary light whose optical path length does not match the optical path length between the electrodes is weakened and (ii) a spectrum light extracted to the outside is steep. This improves the color purity of the organic EL element 20 and allows light to have directivity. Since a wavelength of red light (R), a wavelength of green light (G), and a wavelength of blue light (B) are different from one another, a film thickness of the transparent electrode or the semi-transparent electrode of each of the light sources (the red-light emitting organic EL element (R), the green-light emitting organic EL element (G), and the blue-light emitting organic EL element (B)) needs to be adjusted individually.

(General Description of Organic EL Layer 13)

The following description will discuss the organic EL layer 13. As described above, the organic EL layer 13 should have at least the light-emitting layer. The light-emitting layer is made from a positive and negative charge transporting material obtained by adding a light-emitting dopant to a host material such as a hole-transporting material or an electron-transporting material. Examples of the host material encompass 4,4'-N,N'-dicarbazolyl-biphenyl (CBP).

[Chem. 1]

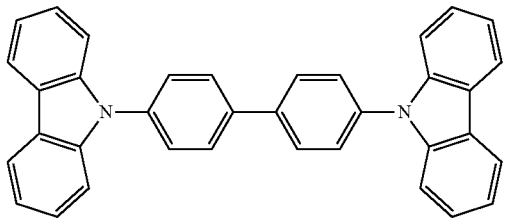

CBP

In a case of manufacturing a light-emitting layer that emits red light, a red-light-emitting dopant is employed as the light-emitting dopant. Examples of the red-light-emitting dopant encompass a red-phosphorescence-emitting dopant such as bis(1-(phenyl)isoquinolinate-N,C2') iridium (III) (acetylacetonate) ($(piq)_2Ir(acac)$). The red-light-emitting layer can be obtained by co-evaporation of the red-light-emitting dopant and the host material. The red-light-emitting layer can, for example, have a thickness of about 5 nm. Note that the red-light-emitting layer in accordance with the present embodiment is not necessarily limited to this.

[Chem. 2]

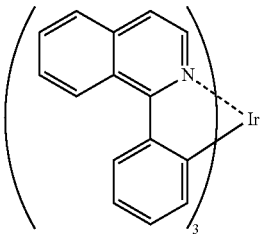

$(piq)_2Ir(acac)$

In a case of manufacturing a light-emitting layer that emits green light, a green-light-emitting dopant is used as the light-emitting dopant. Examples of the green-light-emitting dopant encompass a green-phosphorescence-emitting dopant such as (2-phenylpyridine)iridium ($Ir(ppy)_3$). The green-light-emitting layer is obtained by co-evaporation of the green-light-emitting dopant and the host material. The green-light-emitting layer can, for example, have a thickness of about 20 nm. Note that the green-light-emitting layer in accordance with the present embodiment is not necessarily limited to this.

[Chem. 3]

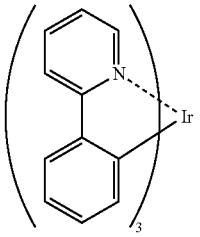

$Ir(ppy)_3$

In a case of manufacturing a light-emitting layer that emits blue light, a blue-light-emitting dopant is used as the light-emitting dopant. Examples of the blue-light-emitting dopant encompass a blue-phosphorescence-emitting dopant such as iridium(III)bis[(4,6-difluorophenyl)-piridinate-N,C2]picolinate (FIrpic). The blue-light-emitting layer is obtained by co-evaporation of the blue-light-emitting dopant and the host material. The blue-light-emitting layer can, for example, have a thickness of about 30 nm. Note that the blue-light-emitting layer in accordance with the present embodiment is not necessarily limited to this.

[Chem. 4]

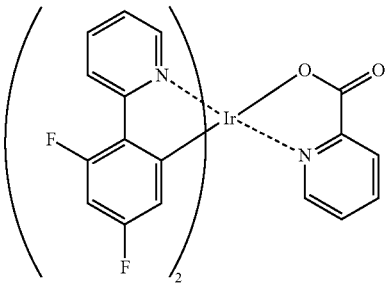

FIrpic

As described above, the organic EL layer 13 can include the hole injection layer, the hole transport layer, the electron blocking layer, the electron injection layer, the electron transport layer, and the hole blocking layer.

The hole injection layer has a function of efficiently injecting, to the light-emitting layer, a hole having been received from the anode. Examples of the hole-injecting material encompass 4,4',4"-tris(N-3-methylphenyl-N-phenylamino) triphenylamine (m-MTDATA) having a starburst amine structure. The hole injection layer can, for example, have a thickness of about 30 nm. Note that the hole injection layer in accordance with the present embodiment is not necessarily limited to this.

[Chem. 5]

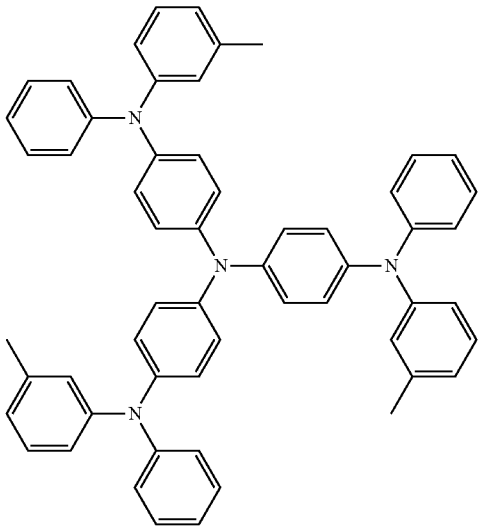

m-MTDATA

The hole transport layer has a function of efficiently transporting, to the light-emitting layer, a hole received from the anode. Examples of the hole-transporting material encompass an aromatic tertiary amine compound such as 4,4',4"-tri(N-carbazolyl)triphenylamine (TCTA). The hole transport layer can, for example, have a thickness of about 10 nm. Note that the hole transport layer in accordance with the present embodiment is not necessarily limited to this.

[Chem. 6]

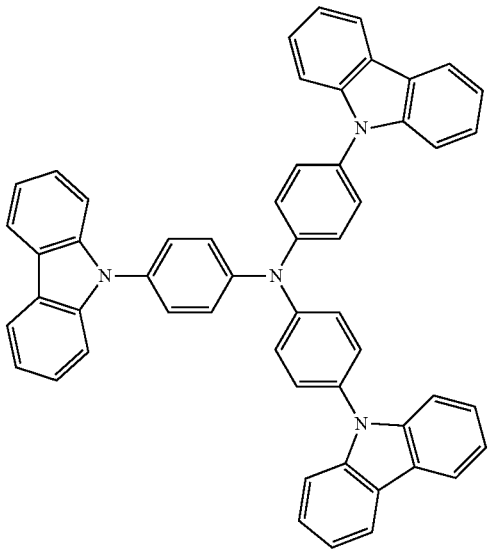

TCTA

The electron blocking layer has a function of blocking an electron from moving to the anode side. Examples of the electron-blocking material encompass 4,4'-bis-[N,N'-(3-tolyl)amino-3,3'-dimethyl biphenyl (HMTPD). The electron blocking layer can, for example, have a thickness of about 10 nm. Note that the electron blocking layer in accordance with the present embodiment is not necessarily limited to this.

[Chem. 7]

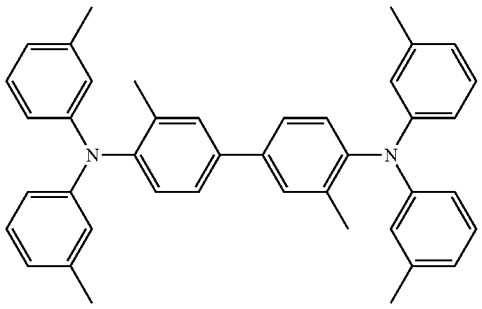

HMTPD

The electron injection layer has a function of efficiently injecting, to the light-emitting layer, an electron received from the cathode. Examples of the electron-injecting material encompass lithium fluoride (LiF). The electron injection layer can, for example, have a thickness of about 1 nm. Note that the electron injection layer in accordance with the present embodiment is not necessarily limited to this. In a case where the electron injection layer is made from LiF, it is preferable that the cathode be formed by co-evaporating magnesium and silver at a ratio of 1:9.

The electron transport layer has a function of efficiently transporting, to the light-emitting layer, an electron received from the cathode. Examples of the electron-transporting material encompass tris(8-hydroxyquinoline)aluminum ($Alq_3$) and 3-phenyl-4(1'-naphthyl)-5-phenyl-1,2,4-triazole (TAZ). The electron transport layer can, for example, have a thickness of about 30 nm. Note that the electron transport layer in accordance with the present embodiment is not necessarily limited to this.

[Chem. 8]

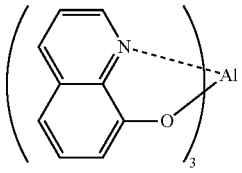

$Alq_3$

[Chem. 9]

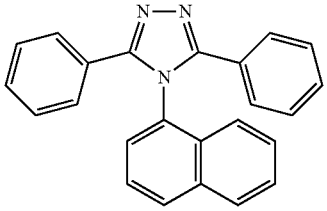

TAZ

The hole blocking layer has a function of blocking a hole from moving to the cathode side. Examples of the hole-blocking material encompass 2,9-dimethyl-4,7-diphenyl-1,10-phenanthroline (BCP). The hole blocking layer can, for example, have a thickness of about 10 nm. Note that the hole blocking layer in accordance with the present embodiment is not necessarily limited to this. In a case where the electron blocking layer and the hole blocking layer are provided, one of the electron blocking layer and the hole blocking layer is preferably formed by vapor deposition polymerization. According to this, a stable electron blocking layer and a stable hole blocking layer can be formed by the vapor deposition polymerization, which is a simple method. In a case where each of the electron blocking layer and the hole blocking layer is made from a positive and negative charge transporting material, it is preferable that at least one of a first condition and a second condition be met. The first condition is that the positive and negative charge transporting material constituting the electron blocking layer has a lowest unoccupied molecular orbital that is higher than a lowest unoccupied molecular orbital of the positive and negative charge transporting material constituting the light-emitting layer. The second condition is that the positive and negative charge transporting material constituting the hole blocking layer has a highest occupied molecular orbital that is lower than a highest occupied molecular orbital of the positive and negative charge transporting material constituting the light-emitting layer. According to this, the electron blocking layer, which blocks electron transfer, and the hole blocking layer, which blocks hole transfer, are provided to sandwich the light-emitting layer constituted by the positive and negative charge transporting material. Accordingly, a hole propagated from the anode and an electron propagated from the cathode are confined within the light-emitting layer. This increases a probability that the hole and the electron are bound to each other again in the light-emitting layer. Accordingly, a driving voltage of the organic EL element 20 can be lowered.

In addition, due to the increased probability of the hole and the electron being bound to each other in the light-emitting layer, internal quantum efficiency is improved and, accordingly, light-emitting efficiency can be improved. Note, however, that there is not an absolute necessity to include both of the electron blocking layer and the hole blocking layer. Merely having one of the electron blocking layer and the hole blocking layer can sufficiently increase the probability of the re-bounding of the hole and the electron. Therefore, the organic EL element 20 can achieve high luminance, high efficiency, and a longer lifetime.

[Chem. 10]

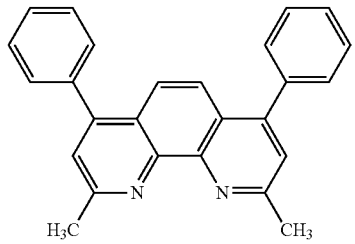

BCP

Note that the organic EL layer 13 can include an electric charge generating layer. In this case, the organic EL layer 13 is formed by, for example, laminating a hole transport layer, a light-emitting layer, an electric charge generating layer, another hole transport layer, another light-emitting layer, and an electron transport layer in this order. That is, it is possible to form an organic EL element 20 including a plurality of light-emitting layers. The electric charge generating layer forms an equipotential surface between the electric charge generating layer and an adjacent one of the light-emitting layers, so that the driving voltage increases and an electric current that flows decreases. This realizes a significantly longer lifetime.

Examples of a material of the electric charge generating layer encompass vanadium pentoxide ($V_2O_5$). The electric charge generating layer can have, for example, a thickness of about 20 nm. Note that the electric charge generating layer in accordance with the present embodiment is not necessarily limited to this.

Examples of a material of the protection layer 15 encompass silicon oxynitride. The protection layer 15 can have, for example, a thickness of about 100 nm. Note that the protection layer 15 in accordance with the present embodiment is not necessarily limited to this.

Note that a diffusing resin layer having a light-diffusing function can be provided on the light extraction side of the organic EL element 20. The diffusing resin layer is a binder resin containing a plurality of light-diffusing particles. Examples of the binder resin encompass an acrylic resin, a polyester resin, a polyolefin resin, and a polyurethane resin. Examples of the light-diffusing particles encompass (i) acrylic particles of an acrylic copolymer, an acrylic terpolymer, or the like of methyl methacrylate, ethyl methacrylate, isobutyl methacrylate, normal butyl methacrylate, normal butyl methyl methacrylate, methyl methacrylate, methyl acrylate, (ii) olefin particles of polyethylene, polystyrene (PS), polypropylene, or the like, and (iii) a copolymer of acrylic particles and olefin particles. Alternatively, the material having the light-diffusing property can be multilayer multicomponent particles or the like obtained by forming particles of a single polymer and subsequently coating the particles of the single polymer with another type of monomer, or the like since such particles have a light-diffusing property. Polymethyl methacrylate (PMMA) is particularly favorable. By providing the diffusing resin layer in which light-diffusing particles are contained in the binder resin, it is possible to uniformly diffuse light that is transmitted through the diffusing resin layer. This allows the organic EL illumination device 1 to achieve a wider viewing angle, an improved light extraction efficiency and a consequent improvement in luminance. The diffusing resin layer can be, for example, about 150 μm thick. Note that the diffusing resin layer in accordance with the present embodiment is not necessarily limited to this.

In a case where the diffusing resin layer is provided, the diffusing resin layer can be a diffusion plate. Examples of the diffusion plate encompass an acrylic resin, a polyester resin, a polyolefin resin, a polyurethane resin, cross-linked polymethyl methacrylate, cross-linked polystyrene, in all of which light-diffusing particles are dispersed.

A wavelength conversion layer for converting a wavelength of light can be further provided on a surface on the light extraction side of the organic EL element 20. It is preferable that the wavelength conversion layer be made from, for example, (i) an inorganic phosphor such as yttrium aluminum garnet (YAG), (ii) a publicly known organic phosphor suitably used in an organic EL element, (iii) other phosphor, or (iv) the like. Use of the wavelength conversion layer allows light emitted from the organic EL element 20 to be converted into light having a desired wavelength. The wavelength conversion layer can have, for example, a thickness of 100 μm. Note that the wavelength conversion layer in accordance with the present embodiment is not limited to this.

On a surface of the organic EL element 20 on the light extraction side, a circularly polarizing plate or a color filter can be provided. The circularly polarizing plate circularly polarizes light emitted from the organic EL element 20, so that reflection of external light can be reduced. The circularly polarizing plate has a structure in which a retardation plate functioning as a ¼λ plate is attached to a linear polarizing plate. By attaching the ¼-retardation film to the linear polarizing plate so that an axis of the ¼-retardation film is tilted by 45° with respect to an absorption axis of the linear polarizing plate, it is possible to obtain a dextrorotatory circularly polarizing plate. Conversely, by attaching the ¼-retardation film to the linear polarizing plate so that an axis of the ¼-retardation film is tilted by 135° (−45°) with respect to the absorption axis of the linear polarizing plate, it is possible to obtain a levorotatory circularly polarizing plate. For example, in a case where the dextrorotatory circularly polarizing plate is used, when light having been transmitted through the linear polarizing plate passes through the dextrorotatory circularly polarizing plate, the light is turned into light that rotates clockwise. When the light rotating clockwise is reflected by a glass surface or the like, a rotation direction of the light is reversed and the light is turned into light that rotates counterclockwise. The light rotating counterclockwise then travels back to the dextrorotatory circularly polarizing plate. In this manner, the dextrorotatory circularly polarizing plate allows only the light rotating clockwise to pass therethrough and absorbs the light rotating counterclockwise. Ultimately, the dextrorotatory circularly polarizing plate can reduce reflected light of external light to almost none. By utilizing this property, the circularly polarizing plate can eliminate reflection of external light at the organic EL illumination device 1.

The retardation plate is a film having a birefringence index, and can be manufactured by drawing a plastic film in a specified direction. The retardant plate can be made from any material that is transparent and capable of being drawn. For example, a polycarbonate polymer, a polyester polymer, a polysulfone polymer, a polystyrenepolymer, a polyphenylene oxide polymer, a polyolefin polymer, or the like can be employed as such material.

In a case where the color filter is used, (i) only light having a desired wavelength out of light emitted from the organic EL element is allowed to exit and (ii) an external light reflection preventing effect and an external light reflection reducing effect can be achieved. As compared with light emitted from an inorganic EL element 20, the light emitted from the organic EL element 20 has a wider spectrum and an end of the spectrum on a long wavelength side extends long. This is problematic in achieving high color purity. However, by additionally using the color filter, it is possible to cut off a part of the spectrum in an unnecessary region so as to obtain a narrow spectrum (about half the width). The external light reflection preventing effect and the external light reflection reducing effect achieved by the color filter are not as high as those achieved by the circularly polarizing plate. However, in a case where the color filter is used, light having a wavelength in an unwanted region out of light emitted from the organic EL element 20 can be eliminated, so that a color purity enhancing effect can be achieved as well at the same time. Furthermore, since the color filter enables more efficient light extraction as compared with the circularly polarizing plate, the organic EL element 20 has a relatively high light-emitting efficiency. Therefore, adopting the color filter in the organic EL illumination device 1 is highly effective.

(Arrangement of Organic EL Element 20)

The illumination panel 10 is basically constituted by an organic EL element 20 that emits white light. Note that, for the purpose of imparting a light controlling property and a color controlling property to the organic EL illumination device 1, it is possible to use instead a plurality of types of organic EL elements 20 that emit light having respective different wavelengths. The one or more organic EL elements 20 can have an identical shape or have respective different shapes. For example, in a case where the illumination panel 10 is constituted by a one or more organic EL elements 20 that emit light with respective different wavelengths, lengths or widths of the respective one or more organic EL elements 20 can vary from luminescent color to luminescent color. In this case, by setting the widths to given values in consideration of properties, such as light-emitting efficiency, of respective light-emitting dopants, it is possible to realize an organic EL illumination device 1 that is excellent in terms of electric power consumption, light emission luminance, and light emission lifetime.

Figure 5:
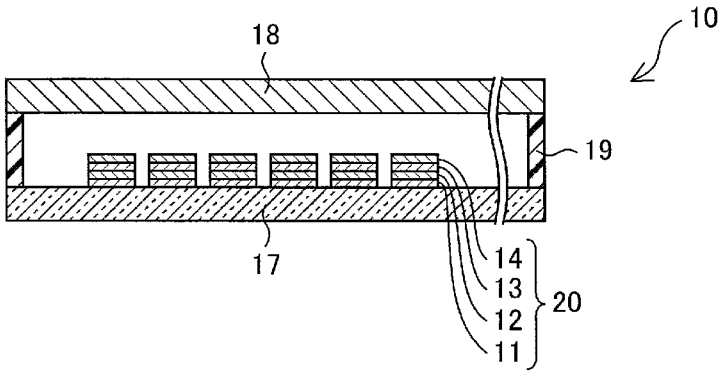
FIG. 5

For example, in a case of using three types of organic EL elements 20 that emit light having respective different wavelengths, the three types of organic EL elements 20 can be a red light-emitting organic EL element (R), a green light-emitting organic EL element (G), and a blue light-emitting organic EL element (B). It is possible to employ a layout in which the organic EL elements 20 are arranged on the first substrate 17 such that a set made up of the red light-emitting organic EL element (R), the green light-emitting organic EL element (G), and the blue light-emitting organic EL element (B) is repeated, as illustrated in FIG. 5. FIG. 5 is a view illustrating an example of an arrangement of the organic EL elements 20. FIG. 5 is simplified for facilitating understanding of the layout of the organic EL elements 20.

In a case where, for example, two types of organic EL elements 20 that emit light having respective different wavelengths, an orange light-emitting organic EL element and an blue light-emitting organic EL element can be used as the two types of organic EL elements 20. Here, in order that a single organic EL element emits light of a plurality of colors, areas of the organic EL element 20 can be painted with respective different colors by a technique such as mask patterning. According to this, it is possible to impart a light controlling property and a color controlling property to the organic EL illumination device 1 by means of the single organic EL element 20.

In a case where a one or more organic EL elements 20 having respective different colors are arranged in the illumination panel 10, it is possible to employ (i) a layout in which organic EL elements 20 emitting light of the same color are arranged in line so that lines of respective different colors of light are parallel with each other, or (ii) other layout. For example, in a case where three types (R, G, and B) of organic EL elements 20 are used, the organic EL elements 20 can be arranged such that in a set of organic EL elements 20 made up of an organic EL element R, an organic EL element G, and an organic EL element B, the organic EL elements 20 arranged to form an L-shape or arranged radially.

The description above discussed an arrangement in which the organic EL elements 20 are arranged side by side. Note, however, that the configuration of the organic EL elements 20 in accordance with the present embodiment is not limited to this. For example, the organic EL elements 20 can have a tandem structure in which light-emitting layers of respective colors are laminated.

Note that (i) the support substrate 11 of each organic EL element 20 can be in contact with the first substrate 17 or (ii) the second electrode 14 on an opposite side of the support substrate 11 can be in contact with the first substrate 17. In a case where the second electrode 14 of each organic EL element 20 is arranged to be in contact with the first substrate 11, the second electrode 14 serves as a lower electrode and the first electrode 12 serves as an upper electrode. As such, in a case of providing an insulating film for insulating the conductive wires 9 on the first substrate 17 from the organic EL element 20, the insulating film is provided between the second electrode 14 and the first substrate 17. In a case where the organic EL element 20 has a protection layer 15, the protection layer 15 can be employed as an insulating film. Note, however, that the present embodiment is not necessarily limited to this. It is possible to separately provided an insulating film between the protection layer 15 and the first substrate 17.

(Another Example of Arrangement of Organic EL Element 20)

Figure 6:
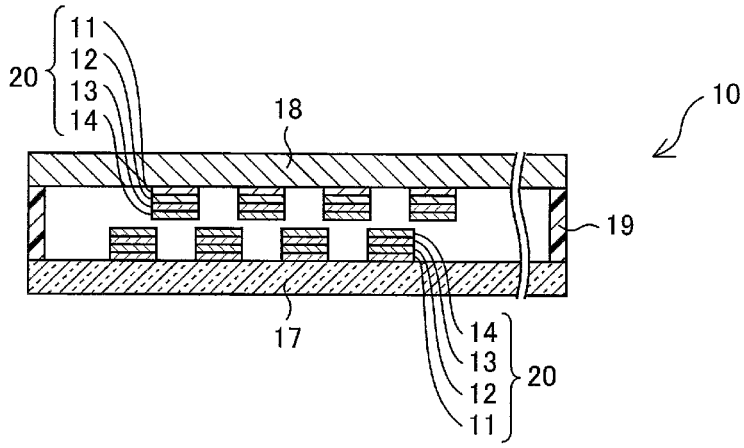
FIG. 6
Figure 7:
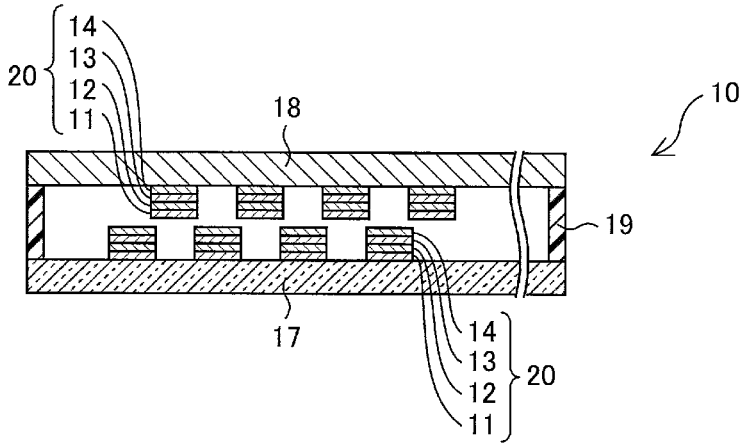
FIG. 7
Figure 8:
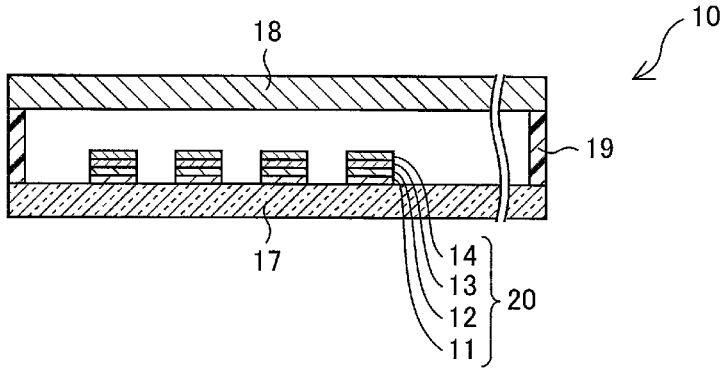
FIG. 8
Figure 9:
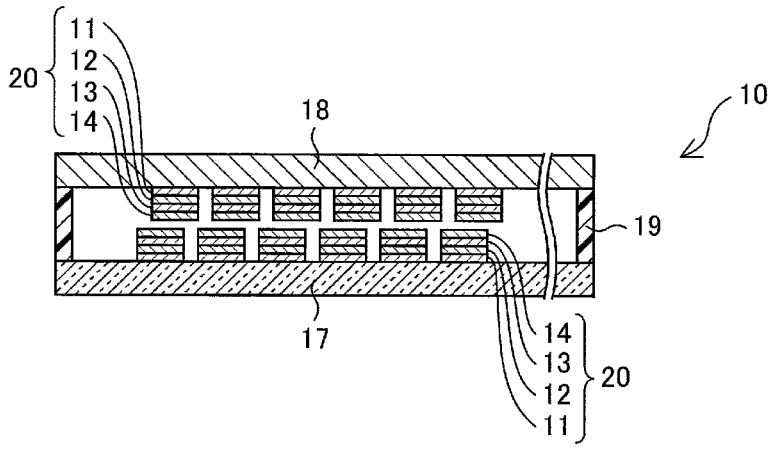
FIG. 9

The description above discussed a configuration in which the organic EL elements 20 are provided on the first substrate 17. However, the present embodiment is not limited to this. For example, the organic EL elements 20 can be provided on each of the first substrate 17 and the second substrate 18. The description above discussed a configuration in which each organic EL element 20 is provided so that the support substrate 11 and the first substrate 17 are in contact with each other. However, the present embodiment is not particularly limited to this, and can employ a configuration in which the second electrode 14 is in contact with the first substrate 17 or the second substrate 18. This configuration is discussed below with reference to FIGS. 6 through 9. FIG. 6 is a cross-sectional view of an organic EL illumination device 1 in which an organic EL element 20 of a bottom emission type is provided on the first substrate 17, and an organic EL element 20 of a top emission type is provided on the second substrate 18. FIG. 7 is a cross-sectional view of an organic EL illumination device 1 in which an organic EL element 20 of a top emission type is provided on each of the first substrate 17 and the second substrate 18. FIG. 8 is a cross-sectional view of an organic EL illumination device 1 in which an organic EL element 20 of a top emission type is provided on the first substrate 17. FIG. 9 is a cross-sectional view of an organic EL illumination device 1 of a double-sided emission type. For simplicity, FIGS. 6 through 9 omits the protection layer 15.

For example, as illustrated in FIG. 6, it is possible to employ a configuration in which (i) the support substrate 11 of the organic EL element 20 of a bottom emission type is arranged to be in contact with the first substrate 17 and (ii) the support substrate 11 of the organic EL element 20 of a top emission type is arranged to be in contact with the second substrate 18. In this case, the first substrate 17 is made from a material having transparency, and the second substrate 18 is made from a material having light reflectivity. According to this, (i) light emitted from the organic EL element 20 on the first substrate 17 is emitted from a first substrate 17 side and (ii) light emitted from the organic EL element 20 on the second substrate 18 is also emitted from the first substrate 17 side. It is preferable that a position of the organic EL element 20 on the first substrate 17 and a position of the organic EL element on the second substrate 18 do not overlap. According to this, a substantial light-emitting area of the organic EL illumination device 1 can be increased. Note that, as illustrated in FIG. 7, the second electrode 14 of the organic EL element 20 of a bottom emission type can be arranged to be in contact with the second substrate 18. With this configuration, light emitted from the organic EL element 20 provided on the second substrate 18 is released from the first substrate 17 side.

In the configurations above, the organic EL element 20 is provided on the first substrate 17 so that the light exit surface of the organic EL element 20 faces the first substrate 17. Note, however, that the light exit surface of the organic EL element 20 can be arranged to face the second substrate 18 as illustrated in, for example, FIG. 8. That is, the support substrate 11 of the organic EL element 20 of a top emission type can be in contact with the first substrate 17. In this case, light emitted from the organic EL element 20 is reflected by the second substrate 18 having light reflectivity, and light thus reflected is emitted from the first substrate 17 side. That is, the organic EL illumination device 1 can serve as an indirect illumination device. Note that the second electrode 14 of the organic EL element 20 of a bottom emission type can be arranged to be in contact with the first substrate 17.

Furthermore, as illustrated in FIG. 9, each of the first substrate 17 and the second substrate 18 can be made from a transparent material so that light emitted from the organic EL element 20 is emitted via the first substrate 17 side and via the second substrate 18 side. According to this, an organic EL illumination device 1 of a double-sided emission type is obtained. Here, the organic EL element 20 of a bottom emission type is provided on each of the first substrate 17 and the second substrate 18, but the present embodiment is not limited to this.

The description above has discussed a configuration in which the first substrate 17 and the second substrate 18 face each other, but the present embodiment is not necessarily limited to this. For example, it is possible to employ a configuration in which the organic EL element 20 is sealed up in a space of a columnar shape, a rectangular parallelepiped shape, a spherical shape, or the like formed by three or more substrates.

(Method for Manufacturing Organic EL Element 20)

The following description discusses a method for manufacturing the organic EL illumination device 1 in accordance with the present embodiment. First, a method for manufacturing the organic EL element 20 is discussed with reference to FIG. 10. (*a*) of FIG. 10 is a view showing a step of preparing the support substrate 11. (*b*) of FIG. 10 is a view showing a step of forming the first electrode 12. (*c*) of FIG. 10 is a view showing a step of forming the organic EL layer 13. (*d*) of FIG. 10 is a view showing a step of forming the second electrode 14. (*e*) of FIG. 10 is a view showing a step of forming the protection layer 15. (*f*) of FIG. 10 is a view showing a step of cutting out the organic EL element 20. The following description discusses the method for manufacturing the organic EL element 20 by use of concrete examples. Note, however, that the method for manufacturing the organic EL element 20 in accordance with the present embodiment is not necessarily limited to this.

First, as shown in (*a*) of FIG. 10, a film tape 11' of a PET film or the like to be formed into the support substrate 11 is prepared, and the first electrode 12, the organic EL layer 13, the second electrode 14, and the like are sequentially formed on the film tape 11'. In so doing, a plurality of first electrodes 12 are formed on the film tape 11', and the organic EL layer 13, the second electrode 14, and the like are formed by being laminated on each of the plurality of first electrodes 12. Manufacture of the organic EL element 20 is preferably carried out in an environment with lower water concentration such as a glove box under dry air, for example.

Next, as shown in (*b*) of FIG. 10, ITO film (with, for example, a thickness of 150 nm) is formed by sputtering, and the ITO film is partially etched by laser ablation to form the first electrode 12. Then, a surface of the first electrode 12 is cleaned by ultrasonic cleaning and UV-ozone cleaning. The ultrasonic cleaning is carried out for about 10 minutes by using, for example, acetone or isopropyl alcohol (IPA) as a cleaning fluid. The UV-ozone cleaning is carried out for about 30 minutes by using, for example, a UV-ozone cleaning system. In a case where the support substrate 11 (film tape 11') is made of a metal plate or the like, a surface of the metal plate is treated by plasma CVD or the like so as to carry out an insulation process.

Subsequently, as shown in (*c*) of FIG. 10, the organic EL layer 13 is formed on the first electrode 12 by vacuum deposition. Specifically, a film of m-MTDATA (with, for example, a thickness of 30 nm) having a starburst amine structure is formed as the hole injection layer on the first electrode 12. A film of TCTA (with, for example, a thickness of 10 nm) is formed as the hole transport layer (electron blocking layer) on the hole injection layer. Note that a film thickness is measured preferably by a quartz oscillator.

Next, a green-light-emitting layer, a blue-light-emitting layer, and a red-light-emitting layer are laminated in this order, as light-emitting layers, on the hole transport layer. The light-emitting layers can be realized by co-evaporation of two components. The green-light-emitting layer is formed by co-evaporating, for example, CBP (host material) and $Ir(ppy)_3$ (green-light-emitting dopant) so that a ratio of a deposition speed of CBP and a deposition speed of $Ir(ppy)_3$ is controlled to be 0.92:0.08. The green-light-emitting layer has, for example, a film thickness of 5 nm.

The blue-light-emitting layer is formed by co-evaporating, for example, CBP (host material) and FIrpic (blue-light-emitting dopant) so that a ratio of a deposition speed of CBP and a deposition speed of FIrpic is controlled to be 0.92:0.08. The blue-light-emitting layer has, for example, a film thickness of 30 nm.

Similarly, the red-light-emitting layer is formed by co-evaporating, for example, CBP (host material) and $(piq)_2Ir(acac)$ (red-light-emitting dopant) so that a ratio of a deposition speed of CBP and a deposition speed of $(piq)_2Ir(acac)$ is controlled to be 0.92:0.08. The red-light-emitting layer has, for example, a film thickness of 5 nm.

Subsequently, a film of BCP (with, for example, a thickness of 10 nm) is formed as a hole blocking layer on the light-emitting layer, and a film of Alq (30 nm) is formed as an electron transport layer on the hole blocking layer. Then, a film of LiF (0.5 nm) is formed as an electron injection layer on the electron transport layer.

Next, as shown in (*d*) of FIG. 10, an aluminum film (with, for example, a thickness of 100 nm) is formed on the electron injection layer by vacuum deposition. Thus formed is the second electrode 14. Subsequently, as shown in (*e*) of FIG. 10, a SiON film (with, for example, a thickness of 100 nm) is formed as a protection layer 15 on the second electrode 14. Note that the organic EL layer 13 is preferably treated with heat or irradiated with ultraviolet ray at the same time as or after at least one type of materials constituting the organic EL layer 13 is deposited under a vacuum condition. According to this, the substrate is heated due to heat treatment or irradiation with ultraviolet ray. This accelerates a reaction, so that (1) a vapor deposition polymerization can be accomplished and (2) a degree of polymerization can be controlled. In addition, the heat treatment allows controlling an orientation of molecules in an evaporated film. In a case where the ultraviolet irradiation is carried out, it is preferable that a heat treatment is carried out after the ultraviolet irradiation. According to this, the substrate is heated due to the ultraviolet irradiation. This, accelerates a reaction, so that (1) a vapor deposition polymerization can be accomplished and (2) a degree of polymerization can be controlled. In addition, by subsequently carrying out the heat treatment, it is possible to control an alignment of molecules in an evaporated film. Furthermore, it is possible to carry out patterning by (i) transferring a pattern by use of a mask at the time of the ultraviolet irradiation and (ii) removing a portion that is not hardened after the ultraviolet irradiation.

Lastly, as shown in (*f*) of FIG. 10, the film tape 11' is cut into sections each having a predetermined length, so that an organic EL element 20 is cut out one by one.

In a case where the organic EL elements 20 of a respective plurality of colors are used, a length of a margin from a light-emitting region to an end of an organic EL element 20 is designed to be not uniform among the organic EL elements. According to this, even in a case where the organic EL elements 20 are misaligned in a longitudinal direction, the positions of the light-emitting regions can be aligned in the longitudinal direction.

(Method for Manufacturing Organic EL Illumination Device 1)

As described above, in the present embodiment, the plurality of first electrodes 12 are formed on the film tape 11', and the organic EL layer 13, the second electrode 14, and the like are formed by being laminated sequentially on each of the plurality of first electrodes 12. The organic EL layer 13, the second electrode 14, and the like are formed by use of a roll-to-roll deposition apparatus (reel-to-reel deposition apparatus). This will be described with reference to FIG. 11. (*a*) of FIG. 11 is a schematic view illustrating a roll-to-roll deposition apparatus for forming the organic EL element 20 in accordance with the present embodiment. (*b*) of FIG. 11 is a view showing a state in which the organic EL element 20 is arranged on the first substrate 17. (*c*) of FIG. 11 is a view showing a step of arranging the second substrate 18 so as to cover the first substrate 17. (*d*) of FIG. 11 is a view showing a state in which the one or more illumination panels 10 are arranged between the head box 2 and the bottom rail 4.

The film tape 11' on which the plurality of first electrodes 12 are formed is set in the roll-to-roll deposition apparatus, as shown in (*a*) of FIG. 11. The roll-to-roll deposition apparatus includes (i) two rolls 22, around which the film tape 11' is wound and (ii) a plurality of formation parts 23 for forming the organic EL layer 13, the second electrode 14, and the like.

For example, the film tape 11' is fed out so as to pass over each of the plurality of formation parts 23 at a regular speed of 1 m/sec. Accordingly, the each of the formation parts 23 deposits the organic EL layer 13, the second electrode 14, and the like sequentially on the first electrode 12 when the film tape 11' passes over the each of the formation parts 23. Ultimately, a plurality of laminated products of the first electrode 12, the organic EL layer 13, and the second electrode 14 are formed on the film tape 11'.

The film tape 11' on which the first electrode 12, the organic EL layer 13, and the second electrode 14 are laminated is wound around the roll 22. Subsequently, the film tape 11' wound around the roll 22 is divided into sections in predetermined length. Thus manufactured is one or more organic EL elements 20. It is preferable that the organic EL elements 20 having been manufactured are tested by a publicly known test method, so as to single out defective products.

Next, as shown in (*b*) of FIG. 11, the organic EL elements 20 having been manufactured are arranged on the first substrate 17 having holes 16. Thus manufactured is an organic EL panel 10'. In so doing, conductive wires 9 are formed in advance on the first substrate 17 by a method such as (i) vacuum deposition with use of a mask, (ii) sputtering, and (iii) a photolithography technique. Then, the organic EL elements 20 arranged on the first substrate 17 are connected with the conductive wires 9 via connection wires 8 that are manufactured, for example, by means of a lead-free solder or the like.

Subsequently, as shown in (*c*) of FIG. 11, the second substrate 18 having holes 16 is fixed on the first substrate 17 so as to cover the first substrate 17 on which the organic EL element 20*s* are arranged. At this time, the second substrate 18 is arranged so that the holes 16 of the first substrate 17 match the holes 16 of the second substrate 18. Thus manufactured is an illumination panel 10. Note that the second substrate 18 can be fixed by means of, for example, UV-curable resin. Examples of the UV-curable resin encompass epoxy resin such as 30Y-332 manufactured by ThreeBond Co., Ltd.

Lastly, as shown in (*d*) of FIG. 11, one or more illumination panels 10 are arranged between the head box 2 and the bottom rail 4. Specifically, up-and-down cords 3 extending from the head box 2 are passed through the holes 16 of each illumination panel 10, and branch wires 5 connected with the up-and-down cords 3 are connected with the connection wires 8 via the conductive wires 9. In this manner, the organic EL illumination device 1 can be manufactured.

As described above, in the present embodiment, the organic EL element 20 is preferably manufactured by use of the roll-to-roll deposition apparatus. This is because the roll-to-roll deposition apparatus is not large-sized and can utilize a material highly efficiently. However, the present embodiment is not particularly limited to this, and the organic EL element 20 can be manufactured by use of other apparatus.

Other Embodiments

In the description above, the integrated illumination device in accordance with the present embodiment was exemplified as an organic EL illumination device. Note, however, that the integrated illumination device in accordance with the present embodiment can be exemplified as other illumination devices such as an inorganic EL illumination device, plasma illumination device, or Field Emission Lamp (FEL). Although the present embodiment showed a case in which the organic EL illumination device 1 is used as an illumination device, the present embodiment encompass cases in which the organic EL illumination device 1 is used as, for example, organic thin-film solar cells, an organic transistor (organic FET), or the like. Also in these cases, the up-and-down cords 3 are taken up without bending when the illumination device is drawn (i) because it is not being used or (ii) in order to decrease illuminance. This makes it possible to distribute stress that may otherwise be concentrated locally on the up-and-down cords 3. Consequently, it becomes possible to prevent the up-and-down cords 3 from getting broken due to deterioration caused by stress locally concentrated on the up-and-down cords 3.

The present invention is not limited to the above-described embodiments but allows various modifications within the scope of the claims. In other words, any embodiment derived from a combination of two or more technical means appropriately modified within the scope of the claims will also be included in the technical scope of the present invention.

General Overview of Embodiment

As described above, in the integrated illumination device in accordance with the present invention, the tool takes up or lets out the cords so as to (i) cause the one or more illumination panels to move in such a manner as to collect together in a pile and (ii) cause the one or more illumination panels to move in such a manner as to be separated from each other from a state in which the one or more illumination panels are collected together in a pile.

According to the configuration, the one or more illumination panels can be caused to collect together in a pile when the integrated illumination device is not in use.

In the integrated illumination device in accordance with the present invention, each of the electrodes of the each of the one or more organic EL elements is connected with a corresponding one of the cords via a branch wire, and a connection point between the corresponding one of the cords and the branch wire is fixed.

According to the configuration, the connection point between the corresponding one of the cords and the branch wire is fixed, so that supply of electric power from the cords to each illumination panel is stabilized.

In the integrated illumination device in accordance with the present invention, each of the electrodes of the each of the one or more organic EL elements is connected with a corresponding one of the cords via a branch wire, and a connection point between the corresponding one of the cords and the branch wire is movable.

According to the configuration, the connection point between the corresponding one of the cords and the branch wire is movable, so that the illumination panel can be caused to slide when the plurality of illumination panels are caused to collect together in a pile.

In the integrated illumination device in accordance with the present invention, each of the cords is made from an elastic material.

According to the configuration, even if concentration of stress on each of the cords is caused by the one or more illumination panels, it is possible to reduce the concentration of the stress. This allows the integrated illumination device to be used for a long period of time.

In the integrated illumination device in accordance with the present invention, the one or more organic EL elements include a substrate having flexibility.

According to the configuration, the substrate has flexibility, so that the organic EL element can be manufactured by a roll-to-roll manufacturing method. This allows reducing initial investment for installing apparatus, running costs, and the like.

In the integrated illumination device in accordance with the present invention, each of the one or more illumination panels is curved.

In the integrated illumination device in accordance with the present invention, a surface of each of the one or more illumination panels, via which surface light emitted from the each of the one or more organic EL elements exits, is curved convexly.

According to the configuration, light emitted from the integrated illumination device can be easily diffused, so that a wide area of a room or a space in which the integrated illumination device is provided can be lit up.

In the integrated illumination device in accordance with the present invention, a surface of each of the one or more illumination panels, via which surface light emitted from the each of the one or more organic EL elements exits, is curved concavely.

According to the configuration, light emitted from the integrated illumination device can be easily diffused. This allows lighting up, in a concentrated manner, a point, a plane, or the like close to where the integrated illumination device is provided.

Furthermore, according to the configuration, an integrated illumination device in which the illumination panel is curved. This allows a wider variety of designs of the integrated illumination device in accordance with the present invention.

In the integrated illumination device in accordance with the present invention, each of the one or more illumination panels is capable of being curved, and the integrated illumination device further comprises adjusting means for adjusting a curvature of the each of the one or more illumination panels.

According to the configuration, a curvature of each illumination panel can be appropriately adjusted, so that the curvature of the each illumination panel can be set to a desired value. Accordingly, in a case where a surface of the organic EL element, from which surface light emitted from the organic EL element exits, is curved convexly, the light is easily diffused so as to light up a wide area of a room or a space in which the integrated illumination device is provided. In a case where a surface of the organic EL element, from which surface light emitted from the organic EL element exits, is curved concavely, the light is easily condensed so as to light up, in a concentrated manner, a point, a plane, or the like close to where the integrated illumination device is provided In the integrated illumination device in accordance with the present invention, a surface of the each of the one or more organic EL elements, from which surface light emitted from the each of the one or more organic EL elements exits, is curved convexly.

According to the configuration, light emitted from the organic EL element can be diffused. This allows lighting up a wide area of a room or space in which the integrated illumination device is provided.

In the integrated illumination device in accordance with the present invention, a surface of the each of the one or more organic EL elements, from which surface light emitted from the each of the one or more organic EL element exits, is curved concavely.

According to the configuration, light emitted from the organic EL element can be easily condensed. This allows lighting up, in a concentrated manner, a point, a plane, or the like close to where the integrated illumination device is provided.

Furthermore, according to these configurations, even if each illumination panel is not curved, the same effect is brought about by merely designing the organic EL element to be curved.

In the integrated illumination device in accordance with the present invention, the each of the one or more organic electroluminescent elements are capable of being curved, and the integrated illumination device further comprises adjusting means for adjusting a curvature of the each of the one or more organic electroluminescent elements.

According to the configuration, a curvature of the organic EL element can be appropriately adjusted, so that the curvature of the organic EL element can be set to a desired value. Accordingly, in a case where a surface of the organic EL element, from which surface light emitted from the organic EL element exits, is curved convexly, the light is easily diffused so as to light up a wide area of a room or a space in which the integrated illumination device is provided. In a case where a surface of the organic EL element, from which surface light emitted from the organic EL element exits, is curved concavely, the light is easily condensed so as to light up, in a concentrated manner, a point, a plane, or the like close to where the integrated illumination device is provided In the integrated illumination device in accordance with the present invention, each of the cords extends in a vertical direction, and the each of the one or more illumination panels is held horizontally and is caused by the tool to move in the vertical direction.

In the integrated illumination device in accordance with the present invention, each of the cords extends in a horizontal direction and each of the one or more illumination panels is held vertically and is caused by the tool to move in the horizontal direction.

According to these configurations, the tool can, by taking up or letting out the cords, (i) cause the one or more illumination panels to move in such a manner as to collect together in a pile and (ii) cause the one or more illumination panels to move in such a manner as to be separated from each other from a state in which the one or more illumination panels are collected together in a pile.

In the integrated illumination device in accordance with the present invention, the one or more organic EL elements of the each of the one or more illumination panels emit light of a plurality of luminescent colors and are capable of being driven independently on a luminescent color-by-luminescent color basis.

The configuration renders the integrated illumination device capable of toning and light control.

In the integrated illumination device in accordance with the present invention, the electrodes are an anode and a cathode; and one of the anode and the cathode is located on a side opposite to a light exit surface side of each of the one or more illumination panels and is made from a light-reflecting material.

According to the configuration, light emitted from the organic EL element to a non-light exit surface side can be reflected by the electrode having light reflectivity, and the light having been reflected can exit from the light exit surface side. This allows light emitted by the organic EL element to be utilized more efficiently.

In the integrated illumination device in accordance with the present invention, the electrodes are an anode and a cathode, and one of the anode and the cathode is a transparent electrode.

According to the configuration, light emitted from the organic EL element exits from a transparent electrode side. This makes it possible to extract light efficiently to the outside of the organic EL element. In addition, by configuring the electrode on a light extraction side to be a transparent electrode, it is possible to condense light by a microcavity (micro resonator) effect. As a result, light-emitting efficiency and color purity are improved, thereby making it possible to impart directivity and the like to light.

In the integrated illumination device in accordance with the present invention, each of the one or more illumination panels includes one or more organic electroluminescent elements between a pair of substrates facing each other, one of the pair of substrates is located on a side opposite to a light exit surface side of the each of the one or more illumination panels and is made from a light-reflecting material or from a material having a light-reflecting surface, and a gap between the pair of substrates is sealed with a light-reflecting material or with a material having a light-reflecting surface.

According to the configuration, light emitted from a surface other than the light exit surface of the organic EL element is reflected by a wall surface (wall surface of the illumination panel surrounding the organic EL element) of the illumination panel. This enables more efficient extraction of light leaking out from the organic EL element.

In the integrated illumination device in accordance with the present invention, the each of the one or more organic EL elements further includes a diffusing resin layer on a light exit surface side of the each of the one or more organic electroluminescent elements.

In the integrated illumination device in accordance with the present invention, the each of the one or more organic EL elements further includes a diffusion plate on a light exit surface side.

In the integrated illumination device in accordance with the present invention, the each of the one or more organic electroluminescent elements includes a substrate made from a light-diffusing material.

In general, light emitted by the organic EL element is diffused widely. As such, a microcavity (micro resonator) structure is usually employed to adjust an optical path length, thereby causing the light to be resonated and collected. This allows light-emitting efficiency and color purity to be improved and the light to have directivity and the like.

According to the configuration, (i) the light-diffusing resin layer is formed, or the diffusion plate is employed, on the light exit surface side or (ii) the substrate on the light exit surface side is made from light-diffusing material. This causes light emitted from the organic EL element to be transmitted through a light-diffusing portion and emitted from the light exit surface so as to be uniformly diffused. This allows (i) the color purity and the light-emitting efficiency of the integrated illumination device to be improved and (ii) a wider viewing angle to be achieved.

In the integrated illumination device in accordance with the present invention, the each of the one or more organic EL elements further includes an electric charge generating layer.

According to the configuration, a hole propagated from the anode and an electron propagated from the cathode can be efficiently propagated to the light-emitting region. In addition, since (i) an electric charge generation region is formed between organic EL layer and (ii) an equipotential surface is formed between adjacent light-emitting regions, a driving voltage is increased and an electric current that is flowing is decreased. This realizes a longer light emission lifetime.

In the integrated illumination device in accordance with the present invention, the each of the one or more organic EL elements further includes a wavelength conversion layer on a light exit surface side of the organic electroluminescent element.

According to the configuration, the use of the wavelength conversion layer allows light emitted from the each of the one or more organic EL elements to be converted into light having a desired wavelength.

In the integrated illumination device in accordance with the present invention, the each of the one or more organic EL elements further includes a circularly polarizing plate on a light exit surface side of the each of the one or more organic electroluminescent elements.

According to the configuration, light emitted from the each of the one or more organic EL elements can be circularly polarized by means of the circularly polarizing plate. This reduces reflection of external light.

In the integrated illumination device in accordance with the present invention, the each of the one or more organic EL elements further includes a color filter on a light exit surface side of the organic electroluminescent element.

According to the configuration, (i) only light having a desired wavelength out of light emitted from the each of the one or more organic EL elements is allowed to exit and (ii) an external light reflection preventing effect and an external light reflection reducing effect can be achieved.

In the integrated illumination device in accordance with the present invention, the electrodes are an anode and a cathode, the cathode is formed by co-evaporating magnesium and silver at a ratio of 1:9, and the each of the one or more organic electroluminescent elements further includes an electron injection layer made from lithium fluoride.

According to the configuration, an electron injected from the cathode can be efficiently injected to the light-emitting region.

In the integrated illumination device in accordance with the present invention, each of the one or more illumination panels has a hole for passing the cord therethrough.

In the integrated illumination device in accordance with the present invention, the hole is provided at a place in the each of the one or more illumination panels other than a center of each of the one or more illumination panels.

According to the configuration, a cord is passed through the hole of the illumination panel, so that the cord and the illumination panel can be connected with each other. Since the hole is provided at a place in the illumination panel other than the center of the illumination panel, a large area can be secured for the light-emitting portion of the illumination panel. This makes it possible to enhance luminance and illuminance.

In the integrated illumination device in accordance with the present invention, the each of the one or more organic EL elements includes an organic layer which (i) includes a light-emitting region and (ii) is made from a positive and negative charge transporting material.

According to the configuration, the positive and negative charge transporting material (1) can propagate, to the light-emitting region with high mobility and a good balance, a hole injected from the anode and the electron injected from the cathode, (2) has a sufficiently large energy gap (about 3 eV) between a Highest Occupied Molecular Orbital (HOMO) and a Lowest Unoccupied Molecular Orbital (LUMO) and is a wide gap material. As such, a high light-emitting efficiency is realized.

In the integrated illumination device in accordance with the present invention, the electrodes are an anode and a cathode, the light-emitting region is formed by adding a light-emitting dopant to the positive and negative charge transporting material, the each of the one or more organic electroluminescent elements further includes (i) an electron blocking region, which is made from the positive and negative charge transporting material and an electron-blocking material, between the anode and the light-emitting region and (ii) a hole blocking region, which is made from the positive and negative charge transporting material and a hole-blocking material, between the cathode and the light-emitting region, and at least one of a first condition and a second condition is met, the first condition being that a lowest unoccupied molecular orbital of the positive and negative charge transporting material constituting the electron blocking region is higher than a lowest unoccupied molecular orbital of the positive and negative charge transporting material constituting the light-emitting region, the second condition being that a highest occupied molecular orbital of the positive and negative charge transporting material constituting the hole blocking region is higher than a highest occupied molecular orbital of the positive and negative charge transporting material constituting the light-emitting region.

According to the configuration, the electron blocking region for blocking electron transfer and the hole blocking region for blocking hole transfer are provided to sandwich the light-emitting region made from the positive and negative charge transporting material. As such, a hole propagated from the anode and an electron propagated from the cathode are confined within the light-emitting region. This increases the probability that the hole and the electron are bound to each other again in the light-emitting region. This makes it possible to lower a driving voltage of the organic EL element.

In addition, since the probability that the hole and the electron are bound to each other again in the light-emitting region is increased, internal quantum efficiency is improved and, accordingly, light-emitting efficiency can be improved. Note, however, that the integrated illumination device does not necessarily have to include both of the electron blocking region and the hole blocking region. Merely having one of the electron blocking region and the hole blocking region is enough to enhance the probability of re-bounding of the hole and the electron. Therefore, the organic EL element can achieve high luminance, high efficiency, and a longer lifetime.

The integrated illumination device in accordance with the present invention, further includes a support cord for supporting the one or more illumination panels, the tool (i) being capable of taking up or letting out the support cord and (ii) causing the support cord to move so as to adjust an angle of rotation of the each of the one or more illumination panels.

According to the configuration, the one or more illumination panels are supported by the support cord, and the support cord can be taken up or let out by the tool. As such, by causing the support cord to move by means of the tool, it is possible to adjust the angle of rotation of the one or more illumination panels. Since it is possible to adjust the angle of the illumination panel to a desired angle by vertically tilting or horizontally rotating the illumination panel rotate, the integrated illumination device can serve as direct illumination and indirect illumination.

In the integrated illumination device in accordance with the present invention method for manufacturing, the each of the one or more organic electroluminescent elements is formed by a roll-to-roll method in the step of forming the each of the one or more organic electroluminescent elements.

According to the method, a large-area integrated illumination device is realized and a manufacturing cost can be reduced.

In the method for manufacturing the integrated illumination device in accordance with the present invention, it is preferable that in the step of forming the each of the one or more organic electroluminescent elements, (i) the light-emitting region is formed by adding a light-emitting dopant to a positive and negative charge transporting material, (ii) an electron blocking region is formed between the anode and the light-emitting region, the electron blocking region being made from the positive and negative charge transporting material and an electron-blocking material, (iii) a hole blocking region is formed between the cathode and the light-emitting region, the hole blocking region being made from the positive and negative charge transporting material and a hole-blocking material, and (iv) at least one of the electron blocking region and the hole blocking region is formed by vapor deposition polymerization.

According to the method, it is possible to form a stable electron blocking region and a stable hole blocking region by means of the vapor deposition polymerization, which is a simple method.

In the method for manufacturing the integrated illumination device in accordance with the present invention, it is preferable that in the step of forming the each of the one or more organic electroluminescent elements, at least one type of materials constituting the organic layer is treated with heat at the same time as or after the at least one type of materials is deposited under a vacuum condition.

In the method for manufacturing the integrated illumination device in accordance with the present invention, it is preferable that in the step of forming the each of the one or more organic electroluminescent elements, at least one type of materials constituting the organic layer is irradiated with ultraviolet ray at the same time as or after the at least one type of materials is deposited under a vacuum condition.

According to the method, the substrate is heated due to heat treatment or ultraviolet irradiation. This accelerates a reaction, so that (1) a vapor deposition polymerization can be accomplished and (2) a degree of polymerization can be controlled. In addition, the heat treatment allows controlling an orientation of molecules in an evaporated film.

In the method for manufacturing the integrated illumination device in accordance with the present invention, it is preferable that in the step of forming the each of the one or more organic electroluminescent elements, the at least one type of materials constituting the organic layer is treated with heat after being irradiated with the ultraviolet ray.

According to the method, the substrate is heated due to the ultraviolet irradiation. This accelerates a reaction, so that (1) a vapor deposition polymerization can be accomplished and (2) a degree of polymerization can be controlled. In addition, the heat treatment subsequently carried out allows controlling an orientation of molecules in an evaporated film.

In the method for manufacturing the integrated illumination device in accordance with the present invention, in the step of forming the each of the one or more organic electroluminescent elementus, patterning is carried out by use of a mask when the at least one type of materials constituting the organic layer is irradiated with the ultraviolet ray.

According to the method, in a case where a surface of the organic layer is patterned, the patterning can be carried out efficiently.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

EXAMPLES

The following description will discuss the present invention in further detail by presenting examples. Note that the present invention is not limited to the examples as long as the present invention is within the scope of the claimed inventions.

Example 1

An organic EL illumination device employing an RGB-stacked white organic EL element that has a strip-like shape and is 450 mm long and 50 mm wide was manufactured. Specifically, a glass substrate about 1000 mm long, 70 mm wide, and 0.7 mm thick was used as each of the first substrate and the second substrate. A conductive wire 100 nm in thickness was formed on a surface of the first substrate under a water pressure of $6\times10^{-4}$ Pa. Two organic EL elements were placed on the first substrate, and the conductive wire of the first substrate is connected with the organic EL elements. Subsequently, the first substrate and the second substrate were bonded with each other via resin, so that an illumination panel was manufactured.

Twenty-five illumination panels manufactured in this manner were placed on a ladder cord connecting the head box and the bottom rail, so that the illumination panels were connected with respective up-and-down cords extending from the head box. Specifically, conductive wires of the illumination panels are connected, by means of lead-free solder, with the branch wires connected to the up-and-down cords. Thus obtained was the organic EL illumination device. In a state where the illumination panels are tilted to be vertical (the organic EL illumination device is fully open), each two illumination panels vertically adjacent to each other overlap by 10 mm. Accordingly, the organic EL illumination device obtained is 1510 mm high ((a width of 60 mm)×(25 panels)+(a nonoverlapping edge portion 10 mm)). When the head box (40 mm wide) and the bottom rail (10 mm wide) are taken into consideration, the organic EL illumination device is 1550 mm high.

The organic EL illumination device thus obtained exhibited a chromaticity of (0.33, 0.33), which was measured by means of a luminance colorimeter BM-5A manufactured by TOPCON CORPORATION. The color temperature of the organic EL illumination device was measured by means of a spectroradiometer MCPD-7000, which is manufactured by Otsuka Electronics Co., Ltd. The measured color temperature was 5600 K, that is, the organic EL illumination device emitted daytime white light. The light emission luminance of the organic EL illumination device measured by the spectroradiometer was 50000 cd/m$^2$ at 17V.

The obtained organic EL illumination device was tested by being raised and lowered 10,000 times. As a result, no change was observed in the performance of the organic EL illumination device.

Example 2

An organic EL illumination device in which a connection point between an up-and-down cord and a branch wire was movable was manufactured. Except in this respect, the organic EL illumination device has the same configuration as that of the organic EL illumination device of Example 1.

In a similar manner with Example 1, the chromaticity and the color temperature of the obtained organic EL illumination device were measured. Similar results were obtained as those in Example 1, both with respect to chromaticity and color temperature.

Example 3

An organic EL illumination device employing organic EL elements each of which has three areas of respective different colors (red, green, and blue) was manufactured. Except in this respect, the organic EL illumination device has the same configuration as that of Example 1. Voltages were applied to the conductive wires so that a ratio of light of luminescent colors red (R), green (G), and blue (B) emitted from the manufactured organic EL illumination device was 30%, 22% and 60%.

As in Example 1, the chromaticity and the color temperature of the obtained organic EL illumination device was measured. The measured chromaticity was (0.31, 0.33) and the measured color temperature was 6800 K. That is, the organic EL illumination device emitted daytime white-colored light.

Example 4

In a similar manner with Example 3, an organic EL illumination device employing organic EL elements each having three areas of respective different colors was manufactured. Unlike in Example 3, voltages were applied to conductive wires so that a ratio of light of luminescent colors red (R), green (G), and blue (B) emitted from the manufactured organic EL illumination device was 46%, 28% and 50%. Except in this respect, the organic EL illumination device has the same configuration as that of Example 1.

In a similar manner with Example 1, the chromaticity and the color temperature of the obtained organic EL illumination device was measured. The measured chromaticity was (0.40, 0.40) and the measured color temperature was 3800 K. That is, the organic EL illumination device emitted electric bulb-colored light.

Example 5

An organic EL illumination device employing three types of organic EL elements (red-light-emitting organic EL element, green-light-emitting organic EL element, and blue-light-emitting organic EL element) was manufactured. Voltages were applied to respective conductive wires so that a ratio of a red-light-emitting organic EL element, a green-light-emitting organic EL element, and a blue-light-emitting organic EL element that were in an on-state in the manufactured organic EL illumination device was 32%, 20% and 58%. Except in this respect, the organic EL illumination device has the same configuration as the organic EL illumination device of Example 1.

In a similar manner with Example 1, the chromaticity and the color temperature of the obtained organic EL illumination device were measured. The measured chromaticity was (0.31, 0.33) and the measured color temperature was 6800 K. That is, the organic EL illumination device emitted daylight-colored light.

Example 6

In a similar manner with Example 3, an organic EL illumination device employing organic EL elements each having three areas of respective different colors was manufactured. Each of the lighting rates of the respective luminescent colors red (R), green (G), and blue (B) of the manufactured organic EL illumination device was caused to change over time to a given value between 0% to 100%. As a result, the organic EL illumination device as a whole emitted light, light emission intensity and luminescent color of which changed by gradation.

Example 7

In a similar manner with Example 3, an organic EL illumination device employing organic EL elements each having three areas of respective different colors was manufactured. Unlike Example 3, setting was made so that a lighting rate of each of the luminescent colors red (R), green (G), and blue (B) of the manufactured organic EL illumination device could be controlled by means of a remote controller. While the organic EL illumination device is in an on-state, the lighting rate of each of the luminescent colors was set to a given value between 0% to 100% by means of the remote controller. As a result, a light emission intensity and a luminescent color of the organic EL illumination device as a whole could be set to respective desired values.

As described in the examples, by taking up the up-and-down cords when the organic EL illumination device is taken up, it is possible to take up the up-and-down cords without causing the up-and-down cords to bend. This makes it possible to distribute stress that may otherwise be concentrated locally on the up-and-down cords. This makes it possible to prevent the up-and-down cords 3 from getting broken because of deterioration caused by stress locally concentrated on the up-and-down cords. Therefore, it is possible to reduce deterioration of the up-and-down cords even in a case where the organic EL illumination device in accordance with the present example is raised and lowered. This allows the properties of the organic EL illumination device to be maintained on a high level.

According to Example 2, even in a case where the connection point between an up-and-down cord and a branch wire connected with the up-and-down cord is movable, the organic EL illumination device can be driven without problems. According to Examples 3 through 5, the organic EL illumination device can employ either (i) organic EL elements each of which has a plurality of areas having respective different colors R, G, and B or (ii) three types (R, G, and B) of organic EL elements. In particular, by setting the lighting rate of each of the luminance colors to a given value, it becomes possible to realize a desired light emission intensity and a desired luminescent color.

According to Example 6, by causing each of the lighting rates of the respective luminescent colors of the organic EL illumination device to change over time to a given value, various light emission intensities and various luminescent colors are obtained. By controlling the lighting rates of the respective luminescent colors as in Example 7, the organic EL illumination device can be configured such that a given value can be selected, any time, as each of the lighting rates of the respective luminescent colors. That is, it becomes possible to impart a light controlling function and a color controlling function to the organic EL illumination device.

INDUSTRIAL APPLICABILITY

The integrated illumination device in accordance with the present invention can be suitably used, for example, as various illuminations such as an office illumination, a store illumination, a facility illumination, and the like.

REFERENCE SIGNS LIST

1: organic EL illumination device
2: head box
3: up-and-down cord
4: bottom rail
5: branch wire
6: ladder cord
7: rod
8: connection wire
9: conductive wire
10: illumination panel
10': organic EL panel
11: support substrate
11': film tape
12: first electrode
13: organic EL layer
14: second electrode
15: protection layer
16: hole
17: first substrate
18: second substrate
19: resin
20: organic EL element
21: grip
22: roll
23: formation parts

The invention claimed is:

1. An integrated illumination device comprising:

one or more illumination panels each including one or more organic electroluminescent elements;

cords for holding the one or more illumination panels; and a tool (i) being capable of taking up or letting out the cords and (ii) causing the cords to move so as to adjust a position of each of the one or more illumination panels, each of the cords having conductivity, a conductive part of the each of the cords being electrically connected with a corresponding one of electrodes of each of the one or more organic electroluminescent elements.

2. The integrated illumination device as set forth in claim 1, wherein:

the tool takes up or lets out the cords so as to (i) cause the one or more illumination panels to move in such a manner as to collect together in a pile and (ii) cause the one or more illumination panels to move in such a manner as to be separated from each other from a state in which the one or more illumination panels are collected together in a pile.

3. The integrated illumination device as set forth in claim 1, wherein:

each of the electrodes of the each of the one or more organic electroluminescent elements is connected with a corresponding one of the cords via a branch wire; and a connection point between the corresponding one of the cords and the branch wire is fixed.

4. The integrated illumination device as set forth in claim 1, wherein:

each of the electrodes of the each of the one or more organic electroluminescent elements is connected with a corresponding one of the cords via a branch wire; and a connection point between the corresponding one of the cords and the branch wire is movable.

5. The integrated illumination device as set forth in claim 1, wherein:

the each of the cords is made from an elastic material.

6. The integrated illumination device as set forth in claim 1, wherein:

the each of the one or more organic electroluminescent elements includes a substrate having flexibility.

7. The integrated illumination device as set forth in claim 1, wherein:

the each of the one or more illumination panels is curved.

8. The integrated illumination device as set forth in claim 7, wherein:

a surface of the each of the one or more illumination panels, via which surface light emitted from the each of the one or more organic electroluminescent elements exits, is curved convexly.

9. The integrated illumination device as set forth in claim 7, wherein:

a surface of the each of the one or more illumination panels, via which surface light emitted from the each of the one or more organic electroluminescent elements exits, is curved concavely.

10. The integrated illumination device as set forth in claim 1, wherein:

the each of the one or more illumination panels is capable of being curved; and the integrated illumination device further comprises adjusting means for adjusting a curvature of the each of the one or more illumination panels.

11. The integrated illumination device as set forth in claim 1, wherein:

a surface of the each of the one or more organic electroluminescent elements, from which surface light emitted from the each of the one or more organic electroluminescent elements exits, is curved convexly.

12. The integrated illumination device as set forth in claim 1, wherein:

a surface of the each of the one or more organic electroluminescent elements, from which surface light emitted from the each of the one or more organic electroluminescent elements exits, is curved concavely.

13. The integrated illumination device as set forth in claim 1, wherein:

the each of the one or more organic electroluminescent elements is capable of being curved; and the integrated illumination device further comprises adjusting means for adjusting a curvature of the each of the one or more organic electroluminescent elements.

14. The integrated illumination device as set forth in claim 1, wherein:

the each of the cords extends in a vertical direction; and the each of the one or more illumination panels is held horizontally and is caused by the tool to move in the vertical direction.

15. The integrated illumination device as set forth in claim 1, wherein:

the each of the cords extends in a horizontal direction; and the each of the one or more illumination panels is held vertically and is caused by the tool to move in the horizontal direction.

16. The integrated illumination device as set forth in claim 1, wherein:

the one or more organic electroluminescent elements of the each of the one or more illumination panels emit light of a plurality of luminescent colors and are capable of being driven independently on a luminescent color-by-luminescent color basis.

17. The integrated illumination device as set forth in claim 1, wherein:

the electrodes are an anode and a cathode; and one of the anode and the cathode is located on a side opposite to a light exit surface side of the each of the one or more illumination panels and is made from a light-reflecting material.

18. The integrated illumination device as set forth in claim 1, wherein:

the electrodes are an anode and a cathode; and one of the anode and the cathode is a transparent electrode.

19. The integrated illumination device as set forth in claim 1, wherein:

the each of the one or more illumination panels includes the one or more organic electroluminescent elements between a pair of substrates facing each other;

one of the pair of substrates is located on a side opposite to a light exit surface side of the each of the one or more illumination panels and is made from a light-reflecting material or from a material having a light-reflecting surface; and a gap between the pair of substrates is sealed with a light-reflecting material or with a material having a light-reflecting surface.

20. The integrated illumination device as set forth in claim 1, wherein:

the each of the one or more organic electroluminescent elements further includes a diffusing resin layer on a light exit surface side of the each of the one or more organic electroluminescent elements.

21. The integrated illumination device as set forth in claim 1, wherein:

the each of the one or more organic electroluminescent elements further includes a diffusion plate on a light exit surface side.

22. The integrated illumination device as set forth in claim 1, wherein:

the each of the one or more organic electroluminescent elements includes a substrate made from a light-diffusing material.

23. The integrated illumination device as set forth in claim 1, wherein:

the each of the one or more organic electroluminescent elements further includes an electric charge generating layer.

24. The integrated illumination device as set forth in claim 1, wherein:

the each of the one or more organic electroluminescent elements further includes a wavelength conversion layer on a light exit surface side of the each of the one or more organic electroluminescent elements.

25. The integrated illumination device as set forth in claim 1, wherein:

the each of the one or more organic electroluminescent elements further includes a circularly polarizing plate on a light exit surface side of the each of the one or more organic electroluminescent elements.

26. The integrated illumination device as set forth in claim 1, wherein:

the each of the one or more organic electroluminescent elements further includes a color filter on a light exit surface side of the each of the one or more organic electroluminescent elements.

27. The integrated illumination device as set forth in claim 1, wherein:

the electrodes are an anode and a cathode;

the cathode is formed by co-evaporating magnesium and silver at a ratio of 1:9; and the each of the one or more organic electroluminescent elements further includes an electron injection layer made from lithium fluoride.

28. The integrated illumination device as set forth in claim 1, wherein:

the each of the one or more illumination panels has a hole for passing the cord therethrough.

29. The integrated illumination device as set forth in claim 28, wherein:

the hole is provided at a place in the each of the one or more illumination panels other than a center of the each of the one or more illumination panels.

30. The integrated illumination device as set forth in claim 1, wherein:

the each of the one or more organic electroluminescent elements includes an organic layer which (i) includes a light-emitting region and (ii) is made from a positive and negative charge transporting material.

31. The integrated illumination device as set forth in claim 30, wherein:

the electrodes are an anode and a cathode;

the light-emitting region is formed by adding a light-emitting dopant to the positive and negative charge transporting material;

the each of the one or more organic electroluminescent elements further includes (i) an electron blocking region, which is made from the positive and negative charge transporting material and an electron-blocking material, between the anode and the light-emitting region and (ii) a hole blocking region, which is made from the positive and negative charge transporting material and a hole-blocking material, between the cathode and the light-emitting region; and at least one of a first condition and a second condition is met, the first condition being that a lowest unoccupied molecular orbital of the positive and negative charge transporting material constituting the electron blocking region is higher than a lowest unoccupied molecular orbital of the positive and negative charge transporting material constituting the light-emitting region, the second condition being that a highest occupied molecular orbital of the positive and negative charge transporting material constituting the hole blocking region is higher than a highest occupied molecular orbital of the positive and negative charge transporting material constituting the light-emitting region.

32. An integrated illumination device as set forth in claim 1, further comprising:

a support cord for supporting the one or more illumination panels, the tool (i) being capable of taking up or letting out the support cord and (ii) causing the support cord to move so as to adjust an angle of rotation of the each of the one or more illumination panels.

33. A method for manufacturing an integrated illumination device, said integrated illumination device including:

one or more illumination panels each including one or more organic electroluminescent elements;

cords for holding the one or more illumination panels; and a tool (i) being capable of taking up or letting out the cords and (ii) causing the cords to move so as to adjust a position of each of the one or more illumination panels, said method comprising the steps of:

forming each of the one or more organic electroluminescent elements by sequentially forming, on a substrate, at least an anode, an organic layer including a light-emitting region, and a cathode;

forming the each of the one or more illumination panels by sealing up the one or more organic electroluminescent elements in a gap between the first substrate and the second substrate;

connecting each of the cords, which have conductivity, with a corresponding one of the anode and the cathode of the each of the one or more organic electroluminescent elements; and forming the tool.

34. The method for manufacturing the integrated illumination device as set forth in claim 33, wherein:

the each of the one or more organic electroluminescent elements is formed by a roll-to-roll method in the step of forming the each of the one or more organic electroluminescent elements.

35. The method for manufacturing the integrated illumination device as set forth in claim 33, wherein:

in the step of forming the each of the one or more organic electroluminescent elements, (i) the light-emitting region is formed by adding a light-emitting dopant to a positive and negative charge transporting material, (ii) an electron blocking region is formed between the anode and the light-emitting region, the electron blocking region being made from the positive and negative charge transporting material and an electron-blocking material, (iii) a hole blocking region is formed between the cathode and the light-emitting region, the hole blocking region being made from the positive and negative charge transporting material and a hole-blocking material, and (iv) at least one of the electron blocking region and the hole blocking region is formed by vapor deposition polymerization.

36. The method for manufacturing the integrated illumination device as set forth in claim 33, wherein:

in the step of forming the each of the one or more organic electroluminescent elements, at least one type of materials constituting the organic layer is treated with heat at the same time as or after the at least one type of materials is deposited under a vacuum condition.

37. The method for manufacturing the integrated illumination device as set forth in claim 33, wherein:

in the step of forming the each of the one or more organic electroluminescent elements, at least one type of materials constituting the organic layer is irradiated with ultraviolet ray at the same time as or after the at least one type of materials is deposited under a vacuum condition.

38. The method for manufacturing the integrated illumination device as set forth in claim 37, wherein:

in the step of forming the each of the one or more organic electroluminescent elements, the at least one type of materials constituting the organic layer is treated with heat after being irradiated with the ultraviolet ray.

39. The method for manufacturing the integrated illumination device as set forth in claim 37, wherein:

in the step of forming the each of the one or more organic electroluminescent elements, patterning is carried out by use of a mask when the at least one type of materials constituting the organic layer is irradiated with the ultraviolet ray.

* * * * *